US005676177A

United States Patent [19]

Shofner et al.

[11] Patent Number: 5,676,177

[45] Date of Patent: Oct. 14, 1997

[54] METHOD FOR OPTIMALLY PROCESSING MATERIALS IN A MACHINE

[75] Inventors: Frederick M. Shofner, Knoxville; Dennis J. Roeder, Powell, both of Tenn.

[73] Assignee: Shofner Engineering Associates, Inc., Knoxville, Tenn.

[21] Appl. No.: 557,717

[22] Filed: Nov. 13, 1995

Related U.S. Application Data

[62] Division of Ser. No. 333,364, Nov. 2, 1994.

[51] Int. Cl.[6] ..... D03J 1/02; B65H 54/70

[52] U.S. Cl. ..... 139/1 C; 364/156; 364/470.11

[58] Field of Search ..... 139/1 C, 1 R; 95/1; 55/467, 385.1; 19/66 R, 200; 364/470.11, 156, 149, 150, 151, 470.13

[56] References Cited

U.S. PATENT DOCUMENTS

| | | | |
|---|---|---|---|
| D. 282,767 | 2/1986 | Shofner . | |
| 1,676,969 | 7/1928 | Sutton et al. | 55/DIG. 18 |
| 2,924,062 | 2/1960 | Sutcliffe | 55/DIG. 18 |
| 3,373,552 | 3/1968 | Scherr | 139/1 C |
| 3,923,482 | 12/1975 | Knab et al. | 55/DIG. 18 |
| 3,926,104 | 12/1975 | El Dorado | 55/385.2 |
| 3,999,911 | 12/1976 | Matsubara | 55/385.2 |
| 4,050,368 | 9/1977 | Eakes | 55/385.2 |
| 4,109,144 | 8/1978 | Vidmar | 55/385.1 |
| 4,222,754 | 9/1980 | Horvat | 55/283 |
| 4,227,552 | 10/1980 | Baumann . | |
| 4,255,169 | 3/1981 | Leliaert et al. | 55/DIG. 18 |
| 4,463,574 | 8/1984 | Spethmann et al. | 364/156 X |
| 4,512,060 | 4/1985 | Shofner . | |
| 4,631,781 | 12/1986 | Shofner . | |
| 4,686,744 | 8/1987 | Shofner . | |
| 4,753,663 | 6/1988 | Neefus et al. . | |
| 4,881,957 | 11/1989 | Shofner . | |
| 5,034,897 | 7/1991 | Sainen | 364/156 X |
| 5,121,522 | 6/1992 | Leifeld et al. . | |
| 5,305,498 | 4/1994 | Lang . | |
| 5,321,621 | 6/1994 | Sainen | 139/1 R |
| 5,361,450 | 11/1994 | Shofner et al. | 139/66 R |
| 5,472,018 | 12/1995 | Verner et al. . | |
| 5,487,766 | 1/1996 | Vannier | 55/385.1 |
| 5,560,194 | 10/1996 | Shofner et al. | 57/264 |

FOREIGN PATENT DOCUMENTS

| | | | |
|---|---|---|---|
| 461 411 | 12/1991 | European Pat. Off. . | |
| 0 604 874 | 7/1994 | European Pat. Off. | 19/200 |
| 0 604 876 | 7/1994 | European Pat. Off. | 19/200 |

(List continued on next page.)

OTHER PUBLICATIONS

International search report dated 15 Apr. 1996 in PCT/US 95/13796.

*Primary Examiner*—Andy Falik
*Attorney, Agent, or Firm*—Carter & Schnedler, P.A.

[57] ABSTRACT

Methods for optimally processing materials in a machine, such as a weaving machine, employing modular environmental control apparatus to control the conditions of gas flows sourced to or captured from various critical zones in materials processing machines. A plurality of processing performance parameters, part of which may respond differently to environmental conditions in one or more process zones, and thus may be in conflict with each other, are jointly controlled to yield maximum gross profit, to produce highest quality, to operate at highest throughput, etc., (but not necessarily simultaneously). One method includes the step of measuring at least one processing performance parameter, and at least partially controlling the processing performance parameter in accordance with a predetermined optimal control strategy by deliberately applying a gas flow conditioned by at least one controlling parameter, the gas flow being applied by a modular control unit. The disclosed embodiments are directed toward modular process zone environmental control in textile processing machines, both in yarn and fabric manufacturing processes, including weaving machines. However, Modular Process Zone Environmental Control (MPZEC) is applicable to materials processing in general.

18 Claims, 19 Drawing Sheets

FOREIGN PATENT DOCUMENTS

| | | | |
|---|---|---|---|
| 2 409 335 | 6/1979 | France . | |
| 690 287 | 3/1940 | Germany . | |
| 40 37 006 | 5/1992 | Germany . | |
| 56-54721 | 4/1981 | Japan . | |
| 56-45721 | 4/1981 | Japan | 55/385.2 |
| 62-261840 | 11/1987 | Japan | 55/422 |
| 1-102232 | 4/1989 | Japan | 55/385.2 |
| 1-238022 | 9/1989 | Japan | 55/385.1 |
| 584 302 | 1/1977 | Switzerland . | |
| WO 96/14262 | 5/1996 | WIPO . | |

METHOD FOR OPTIMALLY PROCESSING MATERIALS IN A MACHINE

CROSS-REFERENCE TO RELATED APPLICATION

This is a division of application Ser. No. 08/333,364, filed Nov. 2, 1994.

BACKGROUND OF THE INVENTION

This invention relates generally to control of environmental parameters for manufacturing processes and, more particularly, to the control of environmental parameters within manufacturing process zones and within employee work zones associated therewith.

Relevant prior art includes central air conditioning systems which can control to or "hold" reasonably uniform (spatially) and stable (temporally) desired humidity and temperature conditions, as monitored by one or more chart recorder/controllers in the process room. They generally, cannot, however, "hold" such air conditions in each and every weaving process zone and cannot always achieve compliance with the OSHA respirable dust standard. Nor can prior art central air conditioning systems significantly effect collection of dust and fiber or reduce noise emissions.

Further, prior art central air conditioning typically cannot control the process zone environmental conditions on a machine-by-machine basis.

Relevant prior also includes travelling cleaners, described hereinbelow in detail.

Relevant patent prior art includes Shofner U.S. Pat. Nos. 4,512,060, 4,631,781 and 4,686,744; Shofner U.S. Pat. No. 4,881,957; and Leifeld et al U.S. Pat. No. 5,121,522.

SUMMARY OF THE INVENTION

Briefly, the invention provides a method for processing materials in a machine, including the steps of measuring at least one processing performance parameter; and at least partially controlling the at least one processing performance parameter in accordance with a predetermined optimal control strategy by deliberately applying a gas flow conditioned by at least one controlling parameter, said gas flow being applied to the machine by at least one modular control unit.

A more particular aspect of the invention is a method for optimally processing materials in a material processing machine such as a weaving machine, having at least one material input, at least one processing zone and at least one material output. First a machinery model is determined which simulates the operation of the materials processing machine given a range of input material parameters at least at a first time by measuring materials processing characteristics of the machine over ranges of environmental parameters within the at least one processing zone, the materials processing characteristics defining the interrelationships between input material parameters and output material parameters over the ranges of environmental parameters; and then defining the machinery model from the characteristics. The step, of determining a machinery model at least a first time may further include measuring material processing characteristics of the machine over ranges of machinery settings. The characteristics then also define the interrelationships between input material parameters and output material parameters over the ranges of machinery settings.

Next, at least some of the input material parameters at the material input of the materials processing machine are measured at least at a second, later time.

At least some of the measured input material parameters are introduced into the model, and environmental parameters within the processing zone are then determined, within a predetermined range of acceptable variation, the environmental parameters optimizing at least one output material parameter. Machinery settings within a predetermined range of acceptable variation may also be determined, which settings also optimize at least one output material parameter.

Finally, material is processed while applying controlled conditioned gas flows to the processing zone to achieve the environmental parameters which optimize at least one output material parameter. In addition, processed with the optimally adjusted machinery.

Another more particular aspect of the invention is a method for processing material in a machine, such as a weaving machine, having at least one processing zone. At least one processing performance parameter is measured and at least partially controlled in accordance with a predetermined optimal control strategy by employing a modular environmental control unit to deliberate apply a gas flow conditioned by at least one controlling parameter to the processing zone of the machine.

The at least one processing performance parameter for example may be trash content, nep content, short material content, trash removal efficiency, nep removal efficiency, short material removal efficiency, machine production efficiency, material value, material throughput, cloth throughput, cloth cleanliness, machine production efficiency, stop frequency, stop rate, machinery production cost, input material value, output material value, input yarn value, output cloth value or profit.

The modular environmental control unit includes a gas flow source element and/or a gas flow capture element. There is a mechanism for selectively portioning the gas flow source element or gas flow capture element in a mechanically predetermined operate position proximate the processing zone, or in a mechanically predetermined retracted position. Elements are provided to control conditions of the gas flow, and there is at least one blower for causing gas flow through the processing zone of the machine.

Yet another more particular aspect of the invention is a method for optimally processing input materials into output materials wherein the method is carried out in a materials processing machine having at least one processing zone, with the machine operating near target operating point parameters. The method includes the steps of providing a range of input material having parameters corresponding to a usable range of such input material, including a substantially complete set of samples of various usable qualities of the input material available; operating the machinery over the entire range of provided input materials to generate output materials having a range of output material parameters; varying environmental parameters within the at least one processing zone over a range of environmental parameters while operating the machine over the range of input material to generate the output material such that substantially all combinations of input materials and environmental parameters are used to generate output materials; testing the input and output materials to determine various output material parameters at substantially all combinations of input material parameters and environmental parameters; generating a database of substantially all combinations of input material parameters, process zone environmental parameters, and output material parameters; selecting a target operating point including at least one parameter selected from the group consisting of input material parameters, process zone environmental parameters, and output material parameters; defining a model of machinery performance based upon a selected portion of the database which is within a predetermined region of the target operating point; using the model for determining at least one optimal parameter from the group consisting of the optimal input material parameters, the optimal process zone environmental parameters, and the optimal output material parameters; and operating the machinery to process input material and to produce output material in accordance with the selected optimal parameter being within acceptable variability of the target operating point.

The step of varying environmental parameters while operating the machine may further include varying the control settings of the machine over their full range such that substantially all combinations of input materials, machine control settings and environmental parameters are used to generate output material. The step of testing may further include testing the input and output materials to determine various output material parameters at substantially all combinations of input material parameters, machine control settings, and environmental parameters. The step of generating a database may further include generating a database of substantially all combinations of input material parameters, machine control settings, process zone environmental parameters and output material parameters. The step of selecting a target operating point may further include selecting a target operating point including at least one parameter selected from the group comprising the input material parameters, machine control settings, process zone environmental parameters, and output material parameters. The step of using the model may further include using the model for determining at least one optimal parameter from the group consisting of the optimal input material parameters, the optimal machine control settings, the optimal process zone environmental parameters, and the optimal output material parameters.

Another more particular aspect of the invention is a method for selecting input materials having optimal input material parameters for input into materials processing machinery to achieve an output of material parameters corresponding to a target operating point. A machinery model is determined which simulates the operation of the materials processing machine given a range of input materials parameters by measuring materials processing machinery characteristics over ranges of operational settings and environmental parameters within processing zones, the materials processing characteristics defining the interrelationships between input materials parameters and output materials parameters over the ranges of machinery settings and environmental parameters; and then defining the machinery model from the machinery characteristics.

Next, characteristics of a desired output materials parameter or profit are determined. The output material parameters are introduced into the machinery model which determines the optimum range of input material parameters. Input materials are selected having parameters coinciding, within an acceptable range of variability, with the determined optimum range of input materials parameters. The selected input materials are provided as input to the materials processing machine, and the machinery is operated with the selected input materials to produce the output corresponding to the target operating point.

Still another more particular aspect of the invention is a method for optimally processing materials in a plurality of sequentially related materials processing machines, each of which has a material input, a material output and a processing zone. A composite machinery model is determined which simulates the operation of the plurality of materials processing machines by measuring materials processing machinery characteristics over ranges of operational settings and ranges of environmental parameters within the processing zones for each of the machines, the characteristics defining the interrelationships between input material parameters and output material parameters over the ranges of machinery operational settings and environmental parameters within the processing zones; and defining the composite machinery model from the measured characteristics.

Input material parameters at the inputs to said material processing machines are measured at least at a second, later time. The input material parameters are introduced into the composite model and then settings and environmental parameters are determined for each machine, within a predetermined range of acceptable variation. The settings and environmental parameters are adjusted to optimize at least one output parameter, and materials are processed with said optimally adjusted machines.

BRIEF DESCRIPTION OF THE DRAWINGS

While the novel features are set forth with particularity in the appended claims, the invention, both as to organization and content, will be better understood and appreciated, from the following detailed description taken in conjunction with the drawings, in which:

DETAILED DESCRIPTION

A. Weaving Essentials: Air Jet Looms

Presented initially below is an overview of the essential elements and operations of the weaving process, and particularly of an "air jet" weaving process zone 60 to be environmentally conditioned and optimally controlled in accordance with the invention. This overview is particularly useful because the apparatus and methods of the invention are much more highly integrated with the weaving process than are prior art environmental controls.

Figure 1:
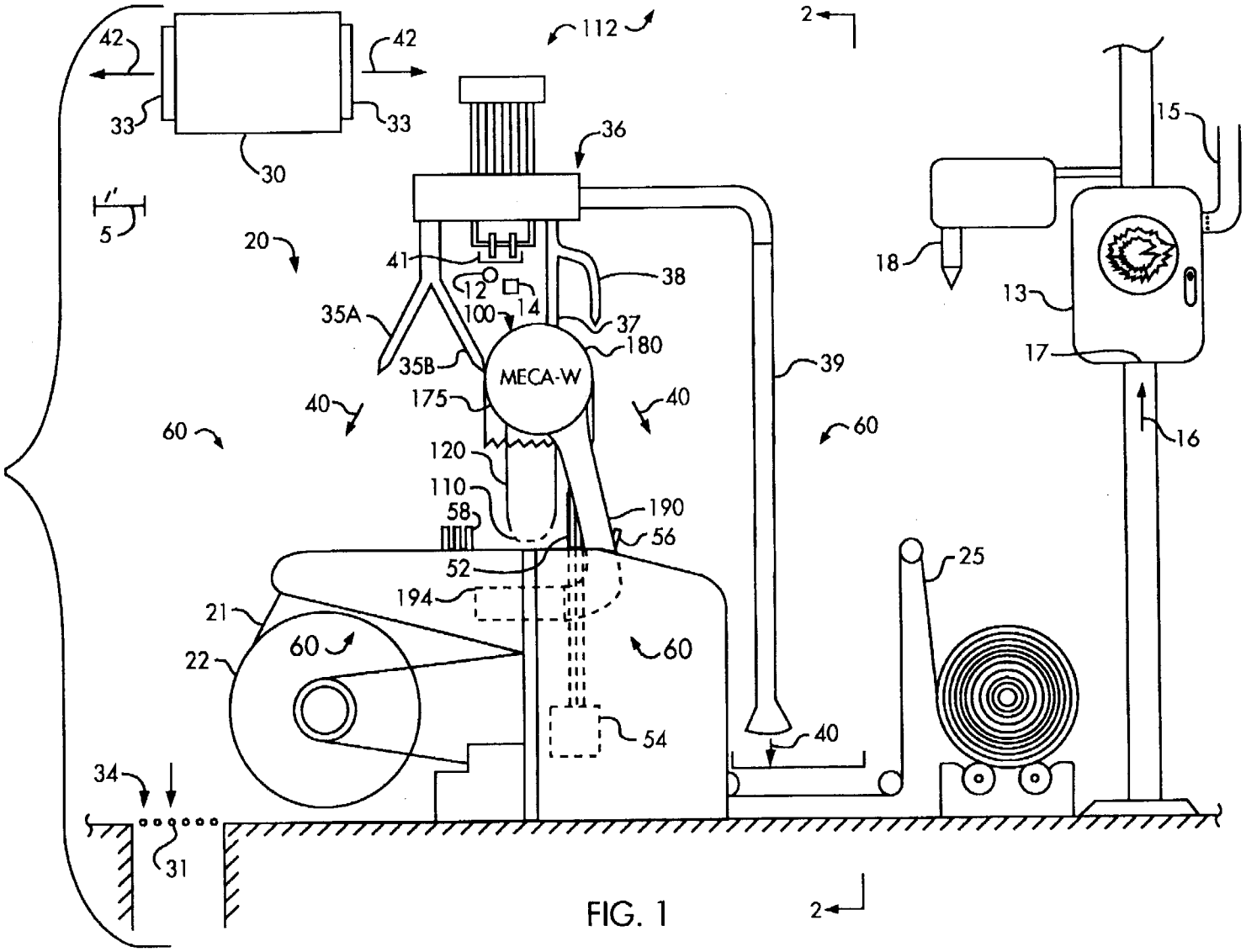
FIG. 1 is a left end view of a modular environmental control apparatus (MECA) unit of the invention applied to a weaving machine shown in side view, the view of FIG. 1 being taken on line 1—1 of FIG. 2.
Figure 2:
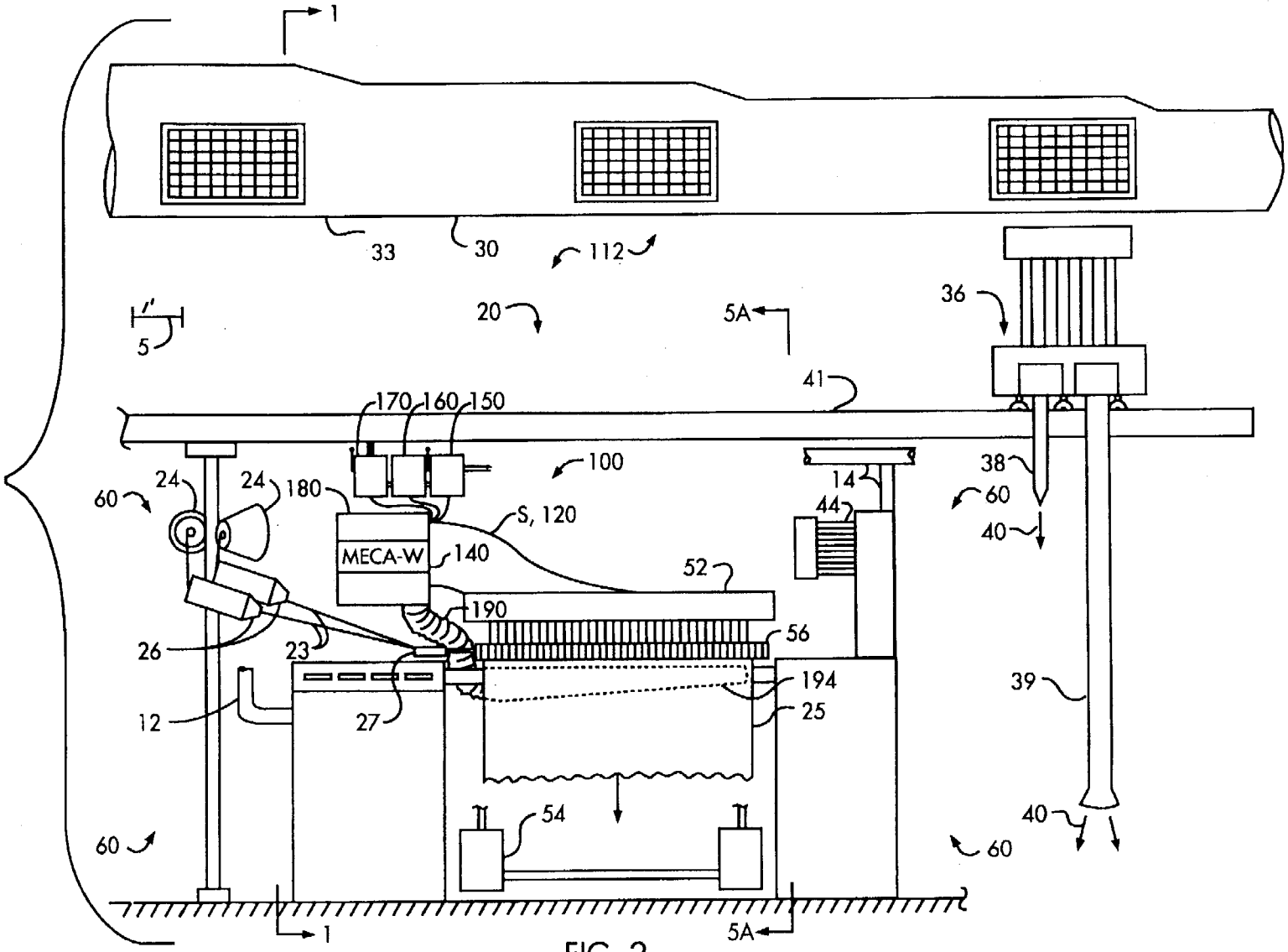
FIG. 2 is a front view of the MECA unit of the invention and a front view of the weaving machine, taken on line 2—2 of FIG. 1.
Figure 3A:
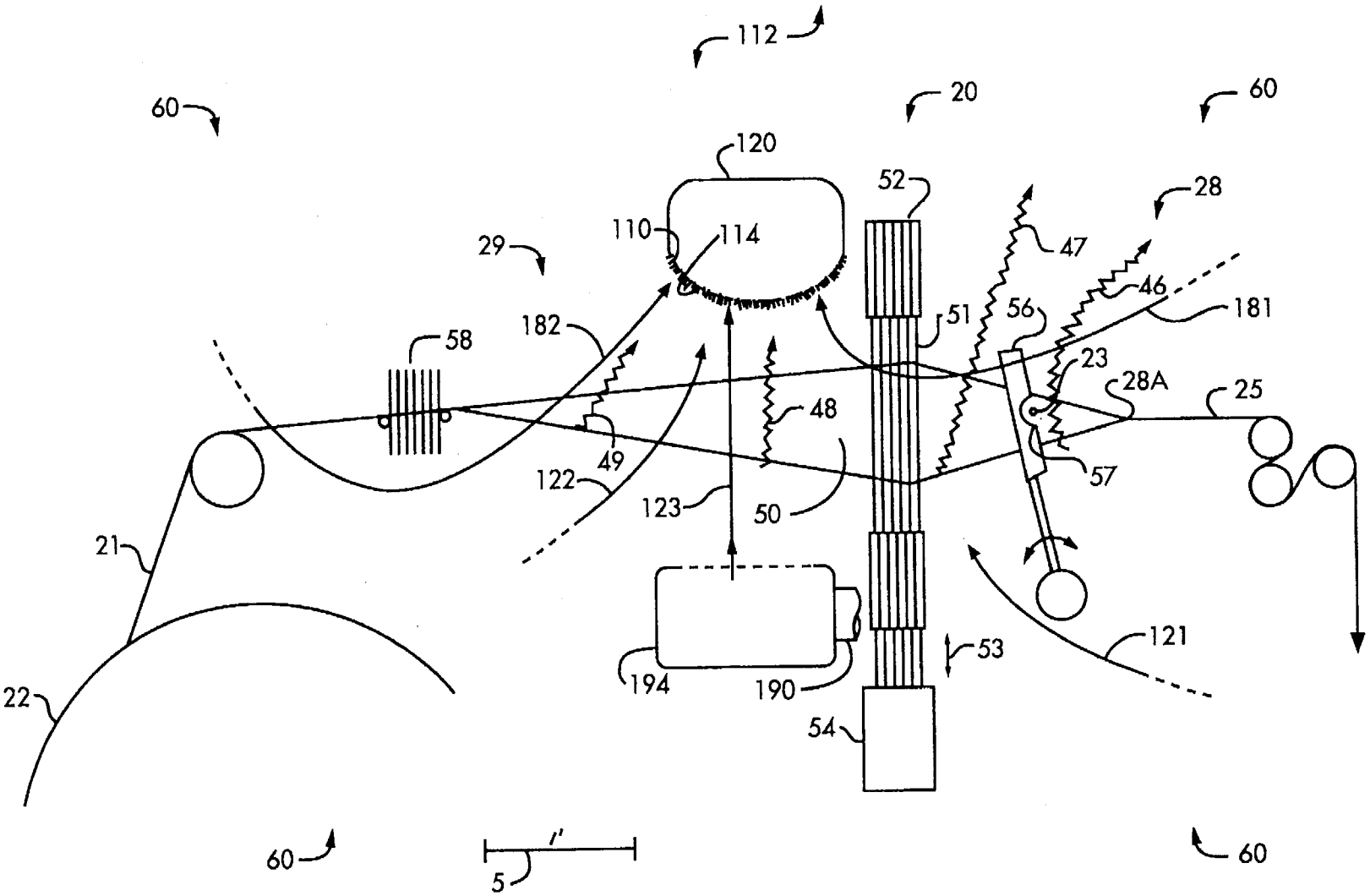
FIGS. 3A and 3B are enlarged views of the weaving process zone.
Figure 3B:
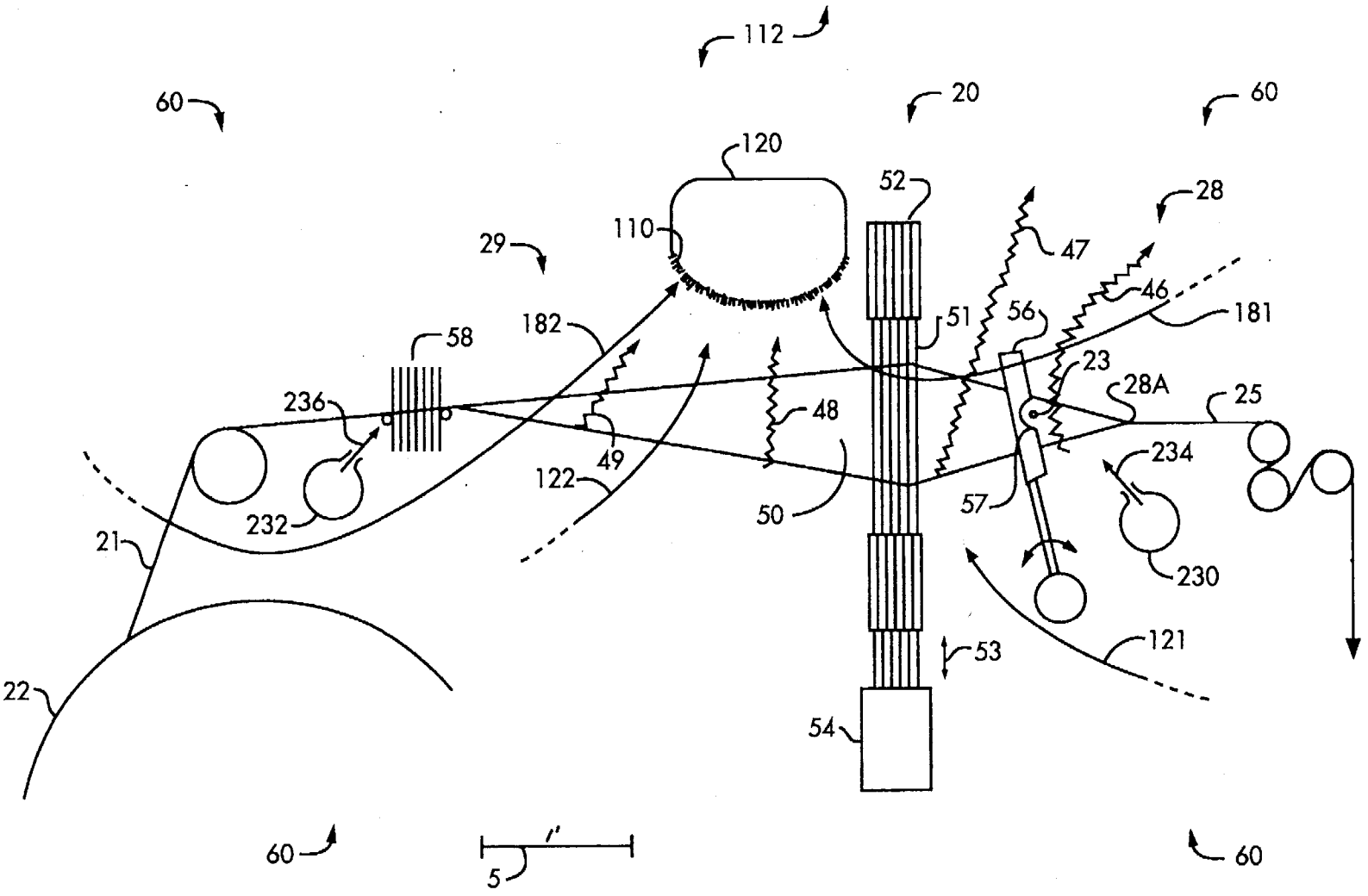

Thus, referring first to FIGS. 1 and 2, a representative environment for the invention is a weaving machine 20 or loom 20 within a weave room environment 112. The weaving machine 20 converts warp yarn 21, supplied from the warp beam 22, plus filling yarn 23 (called weft-yarn in British English), supplied from filling packages 24, into cloth 25. FIGS. 3A and 3B are enlarged views of the Weaving Process Zone, generally designated 60. Also shown in FIGS. 1, 2, 3A and 3B are a number of elements comprising the invention and described hereinbelow, such as a Modular Environmental Control Apparatus (MECA) unit 100, a collector 120, a directed source air conduit 190, and a directed source air diffuser 194.

The weaving process zone more particularly includes the filling packages 24, accumulators 26, filling yarn 23, and primary air jet nozzles 27 (FIG. 2). Accumulators 26 facilitate feeding the filling yarn 23 into the primary air jet nozzles 27 and then into a front shed 28 (FIGS. 3A and 3B). Compressed air and electrical power are supplied by pipe 12 and wire conduit 14.

Filling insertion by means of air jet nozzles 27 leads to the designation "Air Jet Loom." Air Jet Looms are manufactured, for example, by Nissan Motor Company, Textile Division, Tokyo, Japan and Toyota Motor Company, Textile Division, Tokyo, Japan. Toyota manufactures air jet looms under a license from Sulzer-Rüti Company, Rüti, Switzerland. Air jet looms 20 have the major advantage of very high filling insertion or "pick" rates, about 600 per minute, currently. These high production rates lower production costs but place heavy demands on yarn strength and elongation, both of which are influenced strongly by environmental conditions in process zone 60, and which high production rates lead to severe environmental problems including but not limited to those associated with high energy dissipation, high release of dust and fibers, high generation of static electricity, and high noise emissions and turbulent air flows from the weaving process zone 60. Filling insertion rates have risen from about 80/min in 1950 (shuttle looms) to about 250/min in 1970 (projectile, rapier), to about 600/min beginning in the 1980s and operating currently. Next-generation air jet looms having filling insertion rates of 1800/min and even higher are already under field trials.

The revolution in weaving and its associated heavy demands on environmental conditioning will thus be appreciated. Similar considerations apply to all materials processing in general.

Referring again to FIG. 3A, there is a back shed 29 which corresponds to the front shed 28, being respectively in back of or in front of the harness 52. A shed opening 50 is produced by alternating vertical movements of heddle wires 51, through which each of the several hundred to several thousand warp yarn ends 21 pass. The heddle wires 51 are carried by harnesses 52, which harnesses 52 are driven up and down 53 by the harness drive machinery 54 of the loom. Typically, the maximum shed opening is four inches at heddle wires 51 for weaving denim. Openings of two to six inches are found for other fabric constructions.

During operation, when the reed or beater 56 is in its back position, as shown in FIG. 3A, the filling yarn 23 is rapidly inserted by one or more of the primary air jet nozzles 27 (FIG. 2) and carried across the front shed 28 by secondary air jet nozzles (not shown) in the reed tunnel 57. Reed 56 next moves forward to pack or beat the filling yarn 23 into cloth 25. Upon the beater 56 moving backward, the filling yarn 23 remains at the apex 28A of the front shed 28 and moves out of tunnel 57, while heddles 51 (carried by harness 52) shift to cause the warp yarn 21 to envelop the filling yarn 23 and form cloth 25.

Also shown in FIG. 3A is a drop wire stop motion assembly 58 the function of which is to stop the loom 20 in the event of a warp yarn break. This stop motion is achieved when any one of the hundreds to thousands of drop wires fall onto an electrical shorting bar within assembly 58 due to loss of tension in the warp yarn end 21 supporting it. There are also stop motion sensors associated with correct filling yarn insertion, selvage formation, below. Described hereinbelow is the manner in which the apparatus of the invention responds to such stop motions to enable the weaver to access all parts of the weaving machine 20 when repairing the problem that caused the stop; safety and non-interference are critical practical design parameters. Also described hereinbelow is the manner in which several environmental conditions within various parts of process zone 60 are individually controlled.

It will be appreciated that the rapid and intense actions imparted upon the warp 21 and filling yarns 23 yield copious release of dust and fibers, heat, ions, noise, turbulence, etc. in the weaving of spun yarns, especially with cotton, and most especially with denim fabrics. The power consumed by the loom is typically four horsepower, as supplied by loom motor 44. Most of this power dissipation occurs within or under the front and back sheds 28 and 29. Consequently, heated, dried, electrically charged, dust- and fiber-laden air rises as represented by wavy arrows 47, 48, 49 or is fanned away from sheds 28 and 29 in the weaving zone 60 as represented by wavy arrow 46. Noise emissions and turbulence are high as a result of the high production rates and mixing or fanning action of beater 56.

B. Prior Art Environmental Control for the Weaving Process

Accordingly, and as is also illustrated in FIGS. 1 and 2, there are a central conditioned air supply duct 30, having discharge grills or louvers 33, underfloor air return ducts or tunnels 34, and a travelling cleaner 36 having blow-nozzles 35A, 35B, 37, 38 and 39, all previously known. The underfloor return duct 34, with floor grate 31, is found in about half of the weaving processes; wall return is found in the rest, except for a few ceiling returns. The subject invention may be employed in new equipment and in some retrofit installations in conjunction with such prior art apparatus and methods, and they are accordingly described herein in some detail. That is, not only must the subject invention be integrated with the weaving process, it must also be compatible with and integrated into prior art environmental control apparatus.

The subject invention may also be employed alone, thus handling all aspects of weaving materials processing zone environmental control and employee zone environmental control.

More particularly, the air supply ducts 30 and grills 33 in FIGS. 1 and 2 deliver conditioned air 42 from central filtration, refrigeration, ion control, and humidification systems well known in the art. A typical central air conditioning system, designed and constructed according to prior art, delivers about 800,000 cubic feet per minute (CFM) to the typical large weave room processing cotton and attempts to maintain conditions of about 76° F. dry bulb temperature, 70% relative humidity, neutral charge concentrations, and respirable dust concentrations below 750 μg/m3 (8 hour shifts) or 500 μg/m$^3$ (12 hour shifts). In an increasingly large fraction of installations, the attempts are unsuccessful and conditions in the weaving process zone and/or in the employee zone are not satisfactory. Failures to achieve desirable process zone environmental control (PZEC) or employee zone environmental control (EZEC) are in major part attributable to increased production rates associated with modern looms. Further, little or no attention is given to noise control (pressure fluctuations) or to turbulence parameters (velocity fluctuations) in conditioned air 42 supplied to or returned from 34 weave rooms because the weaving machines are very noisy (approximately 95 dBA) and because the vigorous fanning actions of the beater or reed 56 enforce mixing.

It is useful to note that typical prior art central air conditioning systems for cotton fabric weaving have volumetric air exchange rates of about 25/hour or supply and return air flow rates of approximately 2000 CFM/loom. In sharp contrast, one of the important aspects of the invention described hereinbelow is a high localized air exchange rate.

It should also be appreciated that conditioned air 42 is supplied from grills 33 that are typically between eight and thirty feet removed from the process zone 60. Conditioned air 42 provided at such large distances fails to achieve good Process Zone Environmental Control (PZEC) within process zone 60 or control of dust and fiber and other emissions from process zone 60; exemplary data are provided hereinbelow.

It will be appreciated that floor grate inlets 31 into underfloor return air tunnels 34 cause the "sink" for return air to be no closer than about 2.5 feet when the floor grate inlets 31 are located precisely under each shed 28, 29. However, the typical weaving plant must accommodate five to ten weaving machinery changes during its service lifetime of twenty five to fifty years. Different looms will have different "foot-prints." Accordingly, since it is prohibitively expensive to relocate the underfloor tunnels 34 which are usually formed in a massive concrete floor, distances between the weaving process zone 60 and return air inlets 31 can also be as large as 30 feet. If wall and ceiling returns are used, these distances can be as large as 200 feet.

A new but still essentially "central" air conditioning system, modified to deliver different environmental conditions, on a machine-by-machine basis, to the process zones of the textile fiber process known as carding, is disclosed in Shofner et al U.S. patent application Ser. No. 999,226, filed Dec. 31, 1992, now U.S. Pat. No. 5,361,450, titled "Direct Control of Fiber Testing or Processing Performance Parameters by Application of Conditioned Gas Flows."

It may be noted that over shed air supplies (not shown) from central air conditioning systems, provided the supply ducts therefor are compatible with travelling cleaners, and underfloor returns 34, provided they are directly under the process zone 60, coupled closely thereto, and sink several thousand CFM each, can provide good results on a few environmental parameters in the few cases where the weaving room and loom construction permit. Such improvements, using central conditioning, broadly comprise subject matter of the above-referenced U.S. Pat. No. 5,361,450.

Nevertheless, in accordance with the present invention, it is recognized that one of the fundamental limitations of prior art environmental controls is large and varying distances from the weaving process zone.

Further realizations of limitations in prior art devices are significant. Whereas central air conditioner recorder/controller 13 charts may indicate desired 76° F/70% conditions and respirable dust samplers 18 (such as Portable Continuous Aerosol Monitor (PCAM), manufactured by PPM, Inc., Knoxville, Tenn.) may indicate readings below 750 or 500 μg/m$^3$, the reality of denim weaving process zone environmental conditions, for example, are 80° F./60% and 3,000 μg/m$^3$ respirable dust. Total dust mass concentration is much higher.

Travelling cleaner 36, a purpose of which is to blow dust and fibers (sometimes called "fly") from top surfaces onto the floor, moves on electrified track 41 and passes over each loom 20 approximately every eight minutes for a duration of approximately thirteen seconds. In some processes (but not in weaving), travelling cleaners 36 also have capture or suction flows. Travelling cleaner 36 thus serves any one loom, in average, less than 3% of the time. Such travelling cleaners 36 are well known in the art and are manufactured, for example, by Luwa Parks-Cramer, Winston-Salem, N.C.. Carolina.

The travelling cleaner 36 does serve to blow dust and fibers (sometimes called "fly") from top surfaces onto the floor. Unfortunately, a travelling cleaner 36 also blows, with high velocity, hot air jets 40, the dust and fiber accumulations into sensitive parts of the weaving machine, causing stoppages and, sometimes, damage to the machine. A travelling cleaner also blows dust and fibers onto the finished cloth, sometimes causing second quality. Further, the "blowing around or stirring up" of dust or fibers is often a serious aggravation to employees. Finally, travelling cleaners are completely unable to control air conditions, most especially in the weaving process zone 60. Thus, one of the purposes of the subject invention is to supplement or replace such infrequent, ineffective, and troublesome "cleaning" actions with continuous push-pull cleaning actions.

Still further, it can be appreciated that travelling cleaners, which operate on a given loom less than 3% of the time the loom is operating, fail to adequately remove dust and fiber accumulation and have no positive impact whatsoever on process zone environmental conditions. Indeed, except for short-duration removal of dust and fly, their effects on weave zone environmental conditions, on weaving performance, or on personnel are all negative.

From the above discussion, it will be appreciated that a purpose of the subject invention is to replace travelling cleaners. However, such is not the highest objective, which is to improve weaving performance while enhancing gross profit.

C. Modular Process Zone Environmental Control (MPZEC)

The subject invention enables process zone environmental control results heretofore impossible with central air conditioning supplies 30 and returns 34 and travelling cleaners 36. Equally important, MPZEC generally also enables optimal control for materials processing machines according to predetermined optimal control strategies, on a machine-by-machine basis; that is, using a textile example, adjacent weaving machines of the same model can operate with very different process zone environmental conditions, said conditions being provided by a modular environmental control apparatus for each such machine even when weaving the same pattern, to achieve maximum profit for each machine. Clearly, when adjacent machines are weaving different patterns, different process zone conditions will in general prevail to achieve maximum profit. This flexibility is not possible with prior art central air conditioning or travelling cleaners.

FIGS. 1 and 2 illustrate left end and front views of a modular environmental control apparatus (MECA-1) unit 100 which provides environmental control for the process zone 60 of a weaving machine or loom 20. The MECA-1 unit 100 is integrated with loom 20, travelling cleaner 36, A/C supply ducts 30 and returns 34.

After the following disclosure of MECA-1, including prototypical test results, and disclosure of other preferred embodiments, we shall revert to clarification of the differences between central air conditioning, improvements thereon, and MPZEC.

One major difference is much closer proximity of source-capture elements to the process zone. Closer proximity translates into high volumetric exchange rate, a basic concept and engineering parameter in environmental conditioning and which concept is employed hereinbelow to partially explain the subject invention.

C1. Modular Environmental Control Apparatus-Weaving (MECA-1)

Figure 3C:
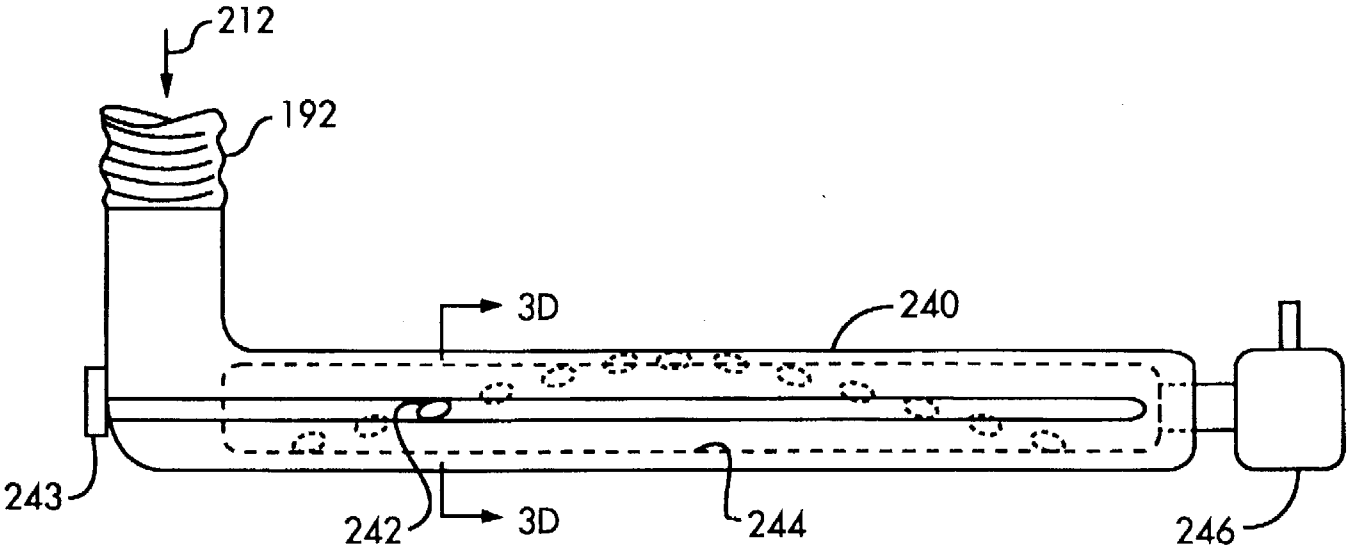
FIG. 3C depicts a scanning blow-off distributor.
Figure 3D:
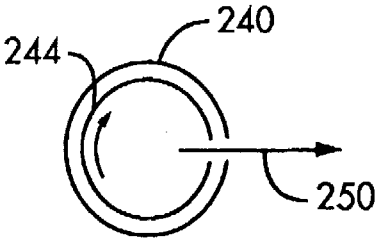
FIG. 3D is a cross-section on line 3D—3D of FIG. 3C.
Figure 4A:
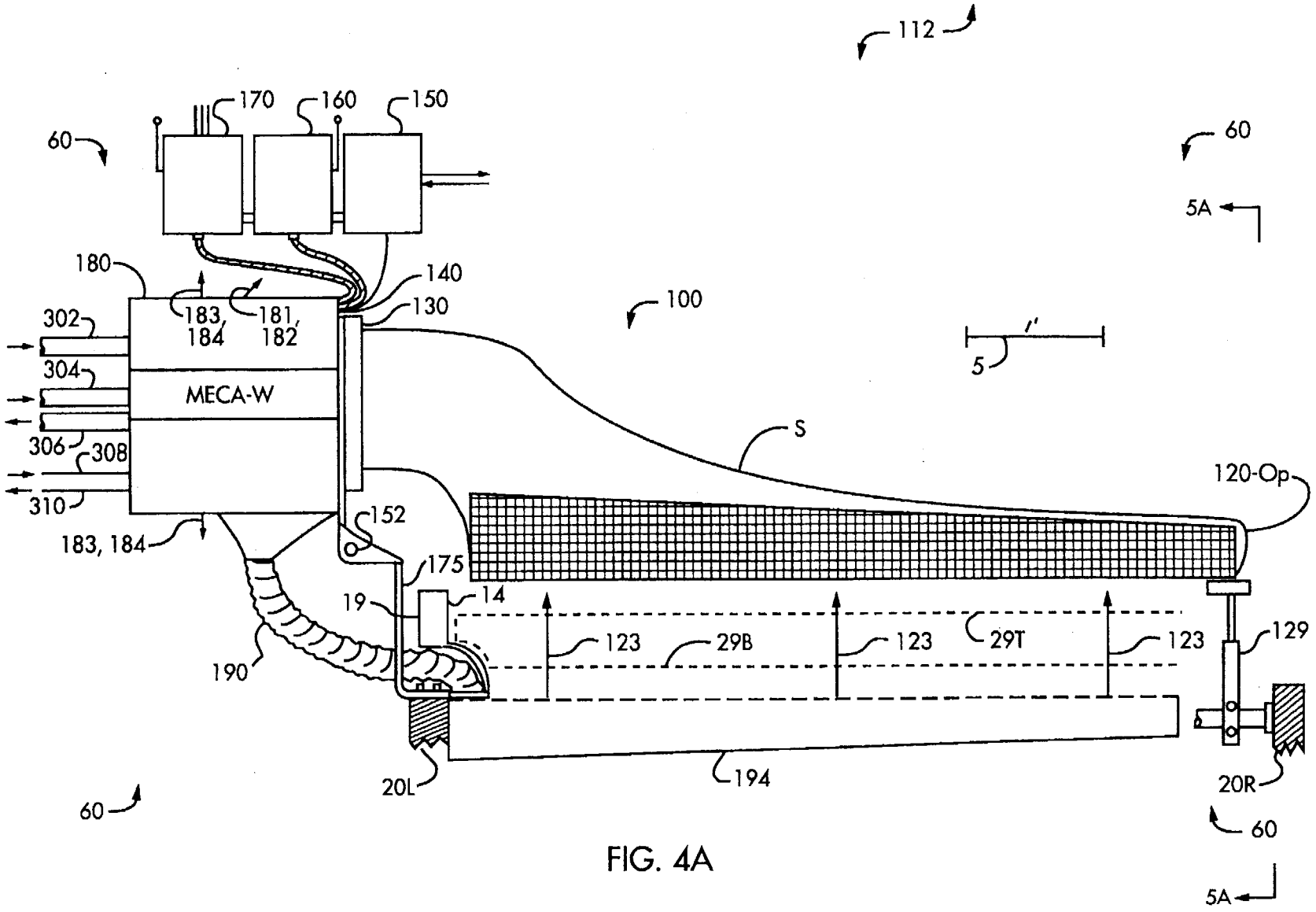
FIGS. 4A and 4B are enlarged front views of the collector and MECA unit of FIG. 2, in two different positions.
Figure 5A:
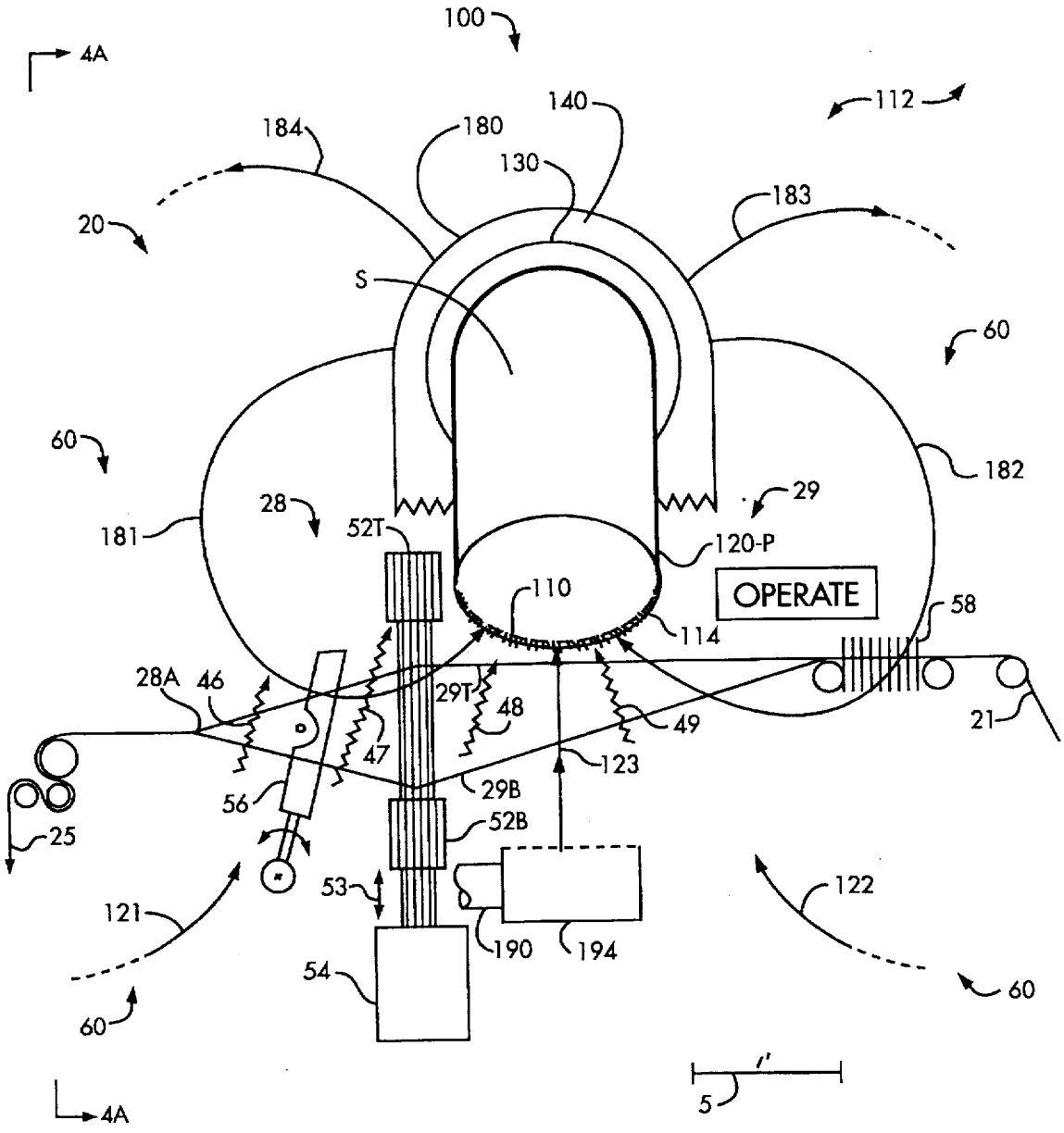
FIGS. 5A, 5B and 5C are right end views of the MECA unit of the invention in various positions taken, in the case of FIG. 5A, generally on lines 5A—5A of FIGS. 2 and 4A, and, in the case of FIG. 5B, generally on line 5B—5B of FIG. 4B.

FIG. 4A provides front view details for MECA-1 unit 100, seen first in FIGS. 1–3A. Only the loom 20 left and right end frames 20L and 20R and the top and bottom of the back shed 29T and 29B are shown for reference and scale 5. FIG. 5A is a right end view corresponding to 4A. Call-out S in FIGS. 4A and 5A is included to clarify the inclination of the top surface of collector 120.

The main elements of this simplified embodiment for a self-contained, modular, "push-pull", "over-under" unit are:

110—Capture Surface(s)
120—Collector (Shown in Operate Position 120-Op in FIGS. 1–3A, 4A, 5A)
130—Collector Mount (Rotating Joint)
140—Air and Collector Drive Unit
150—Control and Monitoring Electronics
152—Collector Position/Function/Selector Switch
160—Control Power (115 VAC, 1ϕ, 60 Hz)
170—Main Power (Disconnect and Circuit Protection) (575 VAC, 3ϕ, 60 Hz);
(Other excitation voltages and frequencies may be used for 160 and 170.)
175—Mounting Frame (FIGS. 4A, 6A)
180—General Source Air Diffuser
190—Directed Source Air Conduit
194—Directed Source Air Diffuser, under back shed These representative elements are further described by their functions which enable advantageous source and capture conditions for air flow components delivered to and taken from the weaving process zone 60.

Figure 6A:
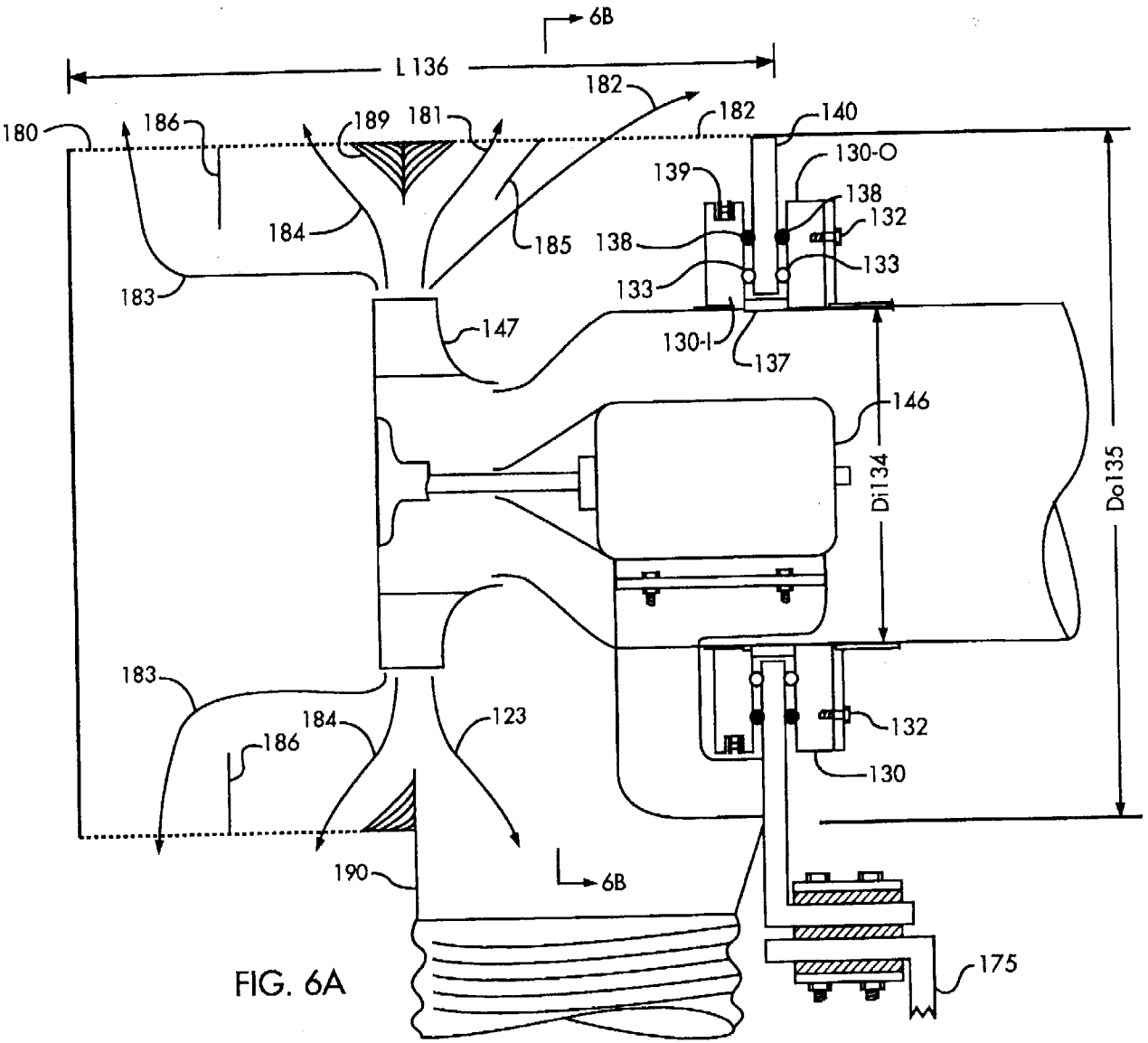
FIG. 6A is an enlarged cross-sectional view of the MECA lower unit.

When loom 20 is in normal operation, collector 120 is in its OPERATE position 120-Op, as seen in FIGS. 1–3A, 4A and 5A. FIGS. 5A and 3A depict an "over/under", "push-pull" embodiment in which only one capture surface 110, over the back shed 29, captures airflow components 181, 182, 121, 122 and 123 and transports these components into collector 120. One general diffuser 180 (FIGS. 4A, 6A) provides source air components 181, 182 back towards the process zone 60 and source air components 183, 184 to the general room environment 112. Capture surface 110 in FIGS. 3A, 4A and 5A captures air flow component 123 almost completely because said flow 123 originates directly (i.e., more tightly coupled) with air from directed source diffuser 194. This source-capture air flow component 123 is delivered to diffuser 194 by conduit 190 and is driven into conduit 190 by blower 147 (FIG. 6A). All other source air components are also driven, in this embodiment, by blower 147. Dust, fibers, heat, ions, gases, etc generated (and absorbed) by the intensive weaving actions and materials in process zone 60, and which net emissions are represented in part by "wavy" arrows 46–49, mix with capture (or "sink" or "return") air flow components 181, 182, 121, 122 and 123. Dust and fibers are collected as a mat 114 on the exterior of surface 110 and are held onto surface 110 by a pressure differential of preferably 1–3 inches water column across it. Significantly, as disclosed in Shofner U.S. Pat. No. 4,881,957, the entire disclosure of which is incorporated herein by reference, this dust and fiber mat 114 becomes a remarkably efficient filter for respirable or so-called "micro-dust" when the face velocity is about 200 FT per minute. The instant embodiment employs total flow of 2000 CFM and has surface area 110 of 10 $FT^2$, so the desired face velocity is achieved. This mat can in many cases be easily cleaned manually, as shown in this preferred embodiment. Importantly, this mode of capture and mat formation enables by far the most cost-effective (i.e. lowest capital and operating costs) apparatus design.

In FIG. 6A source components 181, 182 and 123 are also designated in FIG. 5A as capture components 181, 182 and 123. That is, in addition to source component 123, which is almost completely recirculated, and is thus designated source-capture component 123, other air 181, 182 from diffuser 180 is captured in significant portion by capture surface(s) 110, after mixing with air flow components 121, 122 which originate from the room environment. For flow balance, yet other source components 183, 184 are not immediately captured but return to the room environment.

Source air diffuser 180 in FIGS. 4A, 5A causes, by internal vanes 185 or partitions 186 (FIG. 6A) air flow components 183, 184 to move more or less radially away from diffuser 180 and air flow components 181, 182 to move more or less in a conical pattern back towards process zone 60 where these particular flow components 181, 182 mix with room environment air 121, 122 and are recirculated.

FIG. 6A shows how blower 147 pushes source air into conduit 190 and how said conduit 190 is integrated into diffuser 180.

More to the present point of functionality, in the relatively open and simple over/under, push-pull embodiment of FIGS. 1, 2, 3, 4A, 5A and 6A, the capture air flow components 181, 182, 121, 122 and 123 carry various emissions 46–49 from process zone 60 and the room 112 and are drawn through capture surface 110 and into collector 120 by fan or blower means 147 in drive unit 140. Source air 181–184 and 123, whose total volumetric rate is preferably about 2000 CFM, and which source volumetric rate is essentially identical to the capture air 181, 182, 121, 122 and 123 volumetric rate, is moved back into the process zone 60 and room 112 via general source air diffuser 180 and directed source air diffuser 194. This source air 181–184 and 123 may be filtered, cooled, humidified, ion-controlled, directed, calmed (turbulence) or silenced (noise abatement) as necessary and as further described hereinbelow, or as is well known in the art. We note now, for later reference, that the environmental conditioning (filtration, cooling, etc.) may be different for the different source air flow components, some of which move to the process zone, and others of which move to the employee zone.

It can now be more fully appreciated that one of several novel and important features in our invention is the close proximity of source (such as 194) and capture (such as 110) air flow surface(s) to the weaving process zone 60. We discovered that close proximity greatly facilitates provision of effective air flow components. By close we mean, for example, less than about 2.5 feet between the bottom of collector surface(s) 110 and the top of back shed 29T.

Similarly, superior results are obtained when the top of directed diffuser 194 is less than about 2.5 feet below the bottom of back shed 29B. These specifications of "close" are consistent with the relative relationships in FIGS. 1–3A, 4A and 5A. Some of our trials have been as close as 3 inches, wherein we discovered significant improvement over our own results at thirty inches (2.5 feet) and vast improvements over the 8 to 30 or 2.5 to 30 foot distances for prior art devices described above.

Contrariwise, we also confirmed the obvious negative impact of interference of sheet metal components (such as collector 120) with weaver and fixer access to back shed 29 and we disclose in the next section novel, automatically retractable air flow components to overcome this and other fundamental problems. Before these disclosures, however, we now conclude this section with some clarifying and broadening comments.

Whereas FIGS. 1–3A, 4A, 5A, 6A combine source-capture elements for various air flow components, and these elements of our invention are closely proximate to the weaving process zone, other combinations are provided by our invention. One such alternative configuration is to omit directed source diffuser 194. All source air is thus provided from general diffuser 180 which then operates in combination with capture surface(s) 110. This results in a simpler, more self-contained, modular design.

Another combination is to position capture surface(s) 110 well above 2.5 feet, for example, the weaving process zone 60 but to retain the closely proximate directed source diffuser 194 and general diffuser 180. This design has the advantages of non-interference and collecting cleaner, cooler, moister air from the room environment 112 into collector 120 and sourcing it via diffusers 194 and 180.

Those two comments illustrate simplifications in the direction toward less tightly-coupled configurations. In the other direction, when it is advantageous, more of the source air can be recirculated more immediately back into capture surface(s) 110 in relatively more tightly coupled and more complex designs described in further embodiments of our invention hereinbelow. These more tightly coupled designs enable high local air exchange rates, among other advantages which offset their increased complexity.

C2. Retractable Collector Operational Functions

Figure 4B:
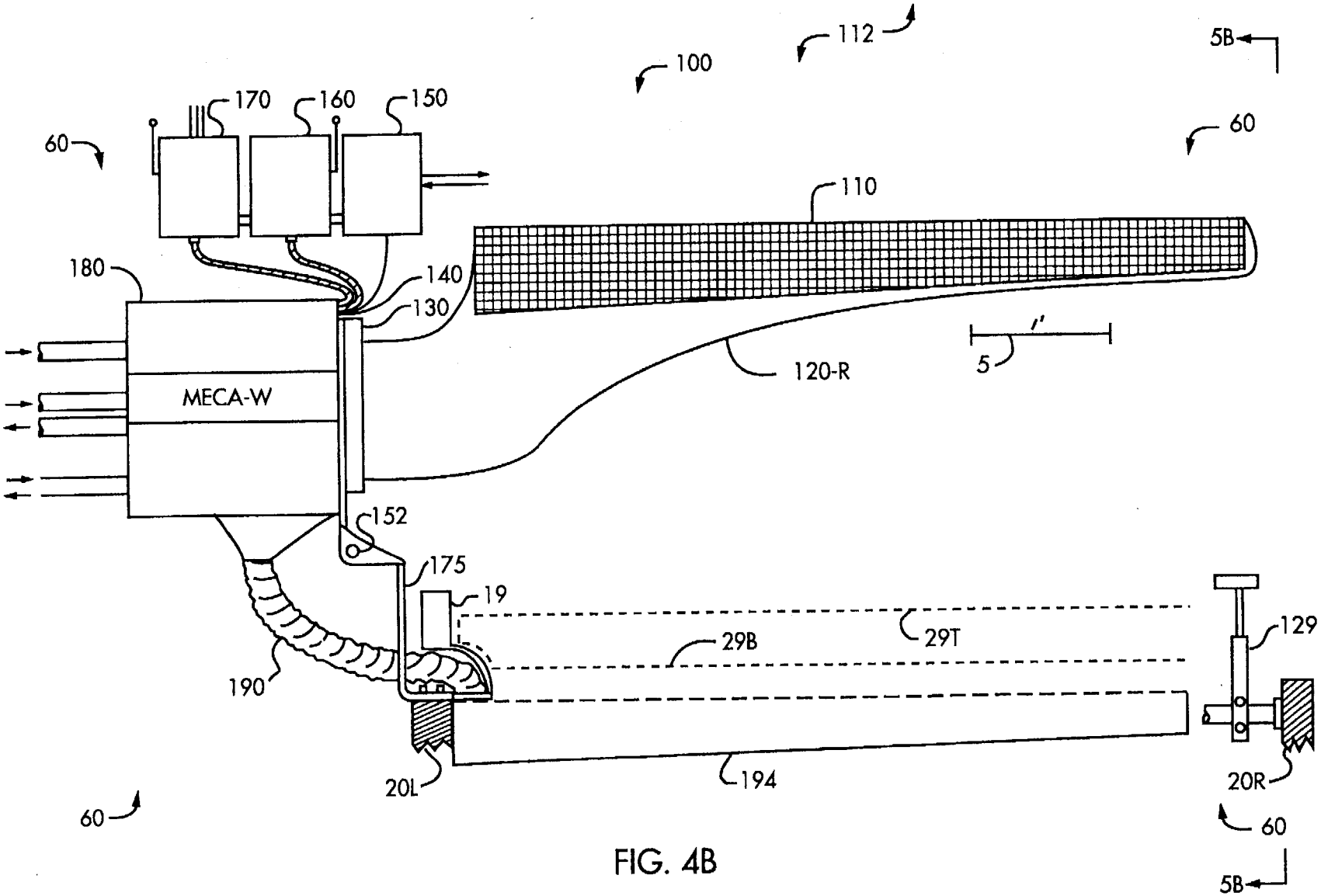
Figure 5B:
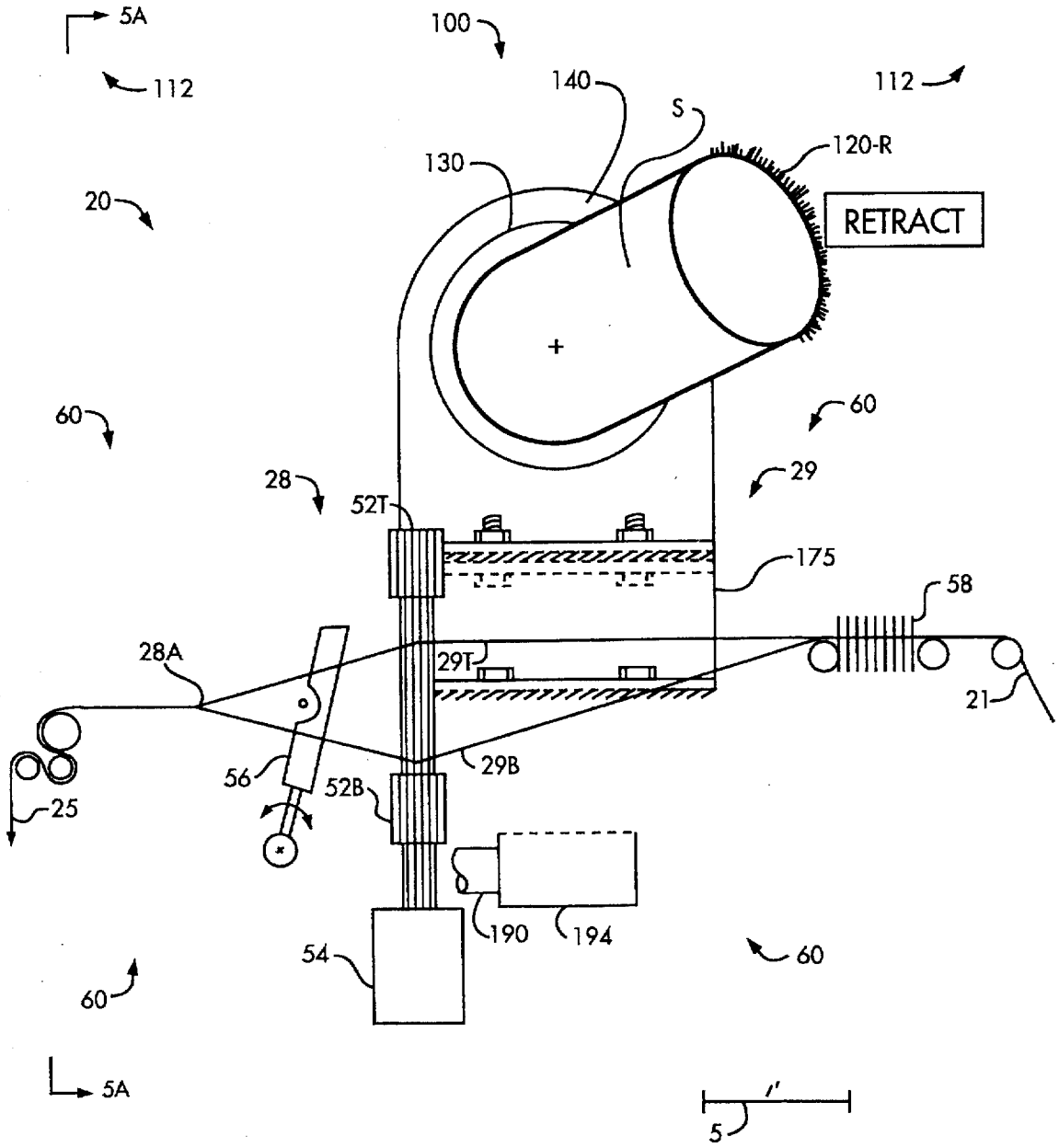
Figure 5C:
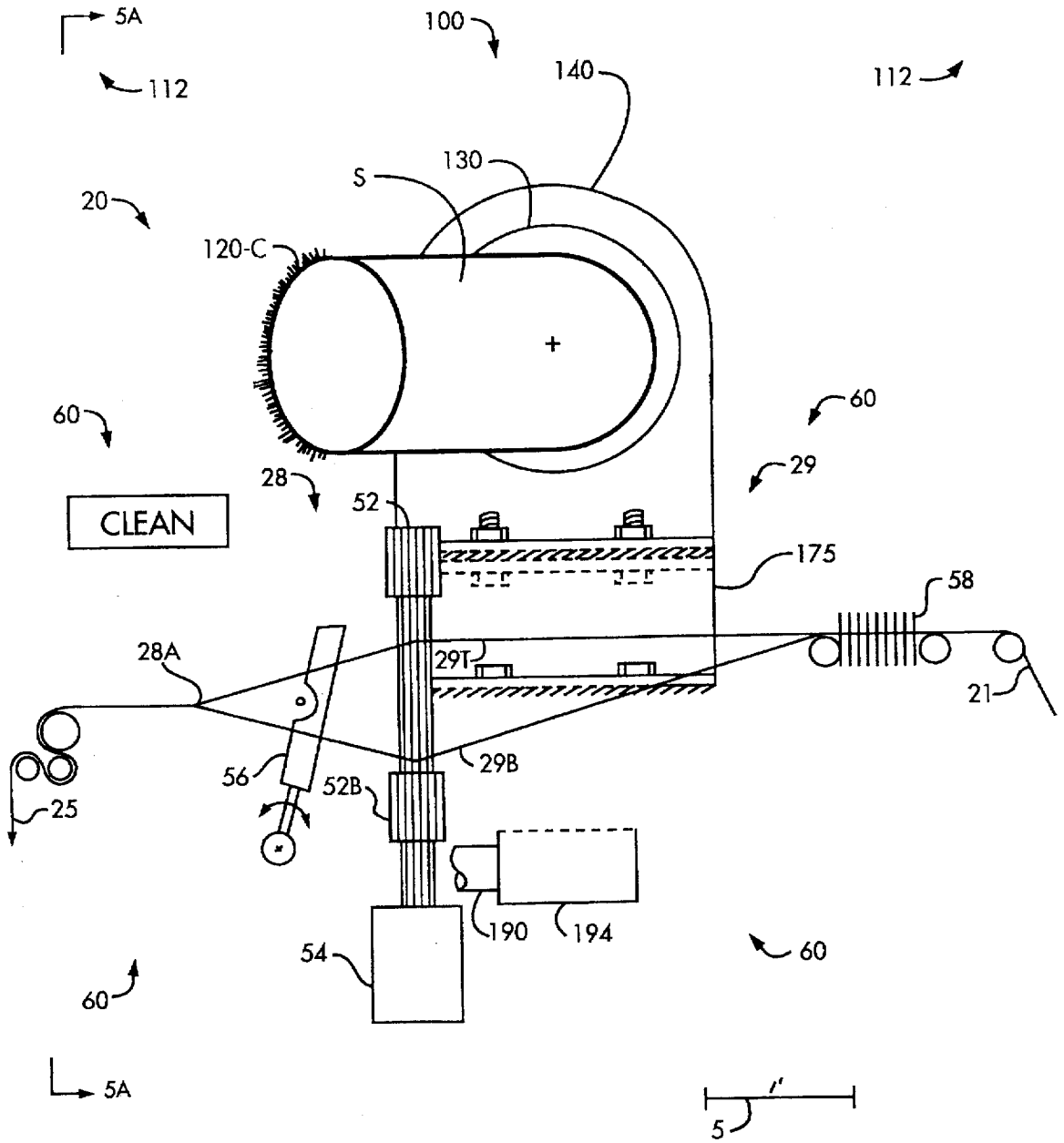

When loom 20 is not in normal operation, in some cases collector 120 must be rotated (counter-clockwise in the orientation of FIGS. 5A, 5B and 5C) to RETRACT position 120-R depicted in FIG. 4B and 5B. Collector 120 is supported and driven by collector mount 130 seen in FIGS. 4B and 5B and which consists of a ball bearing outer ring assembly 131-O seen in more detail in FIG. 6A. Collector mount 130 must freely move and be very structurally sturdy to withstand the large overhung load presented by collector 120 when it moves off rest 129 (FIGS. 4A, 4B).

Collector 120 attaches to outer ring 131-O by means of bolts 132 (or by quick-connect devices, not shown) and is supported and rotated thereby. Robust support and low friction rotation are enabled by sixteen balls 133, 0.5 inch diameter, in each of the inner and outer races for them machined into rings 130-O and 130-I and frame 175. Mounting frame 175 is preferably 0.5 inch thick steel and rings 130-O, 130-I are preferably 0.75 inch thick×1.5 inch width steel. In preferred embodiments for which capture air volumetric flow rate is about 2000 CFM, the inner diameter $D_i$ 134 of collector 120 at collector mount 130 is about 14 inches, the outer diameter $D_o$ 135 of diffuser 180 is about 20 inches, and length L 136 of diffuser 180 is about 20 inches.

Figure 6B:
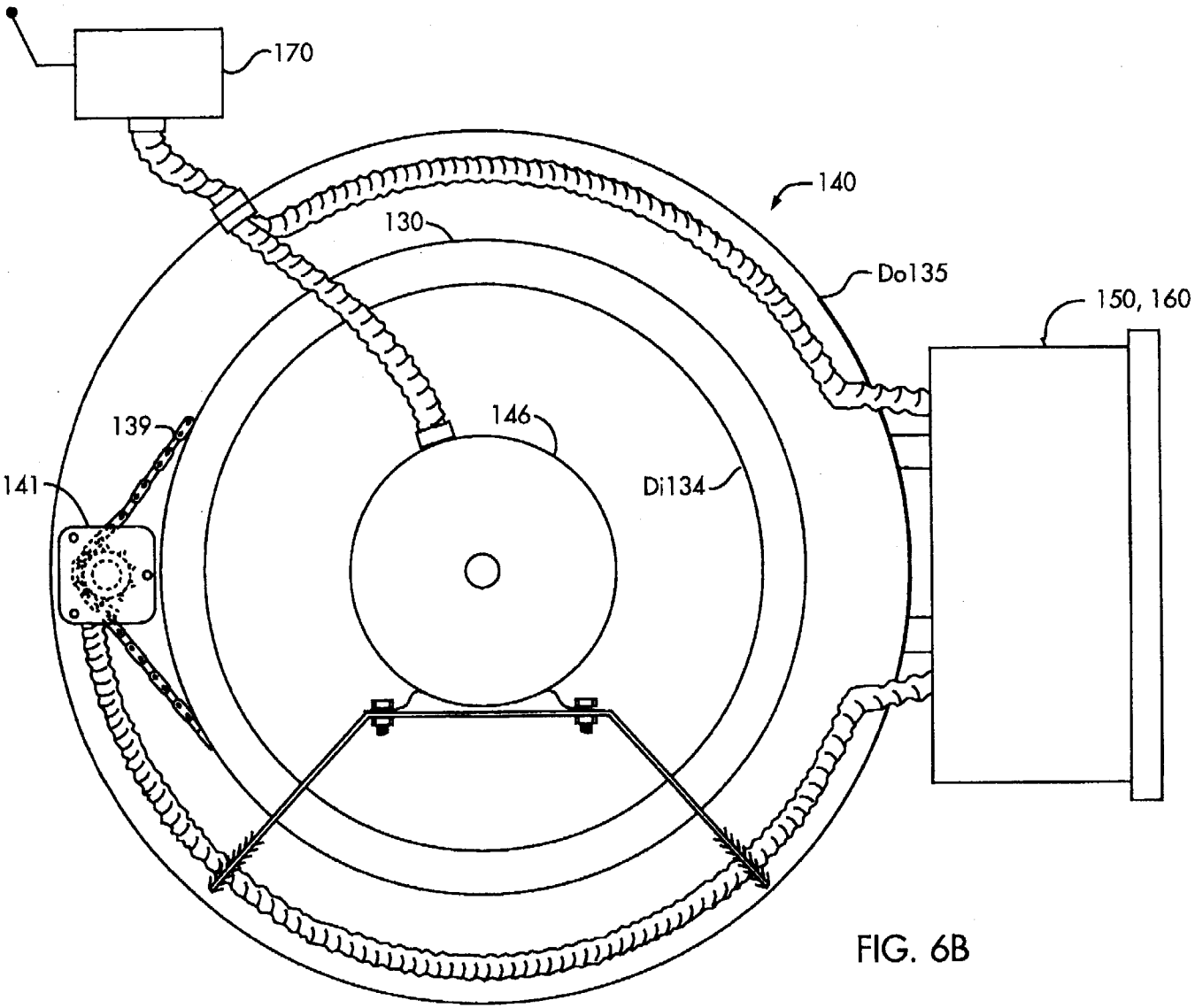
FIG. 6B is a section on line 6B—6B of FIG. 6A.

Inner and outer rings 131 are held together by bolts (not shown) into spacer ring 137. Balls 133 are conventionally lubricated with a medium viscosity grease and are protected from contamination with elastomer seals 138. In particularly dirty environments, felt or metal shields (not shown) are used to keep dust and fibers away from seals 138. Chain 139 (FIGS. 6A, 6B) couples the dual ring, collector mount assembly 130 to gear motor 141 (FIG. 6B). During movement between the OPERATE, RETRACT and CLEAN positions, the collector mount has a rotational velocity of preferably about 1.5 revolutions per minute. Reversible gear motor 141 is controlled by control and monitoring electronics 150, shown as a separate unit in FIG. 4A and mounted above drive unit 140. FIG. 6B shows control power 160 and control and monitoring electronics 150 combined within a single enclosure 150, 160 which is mounted on collector drive unit 140.

Figure 7:
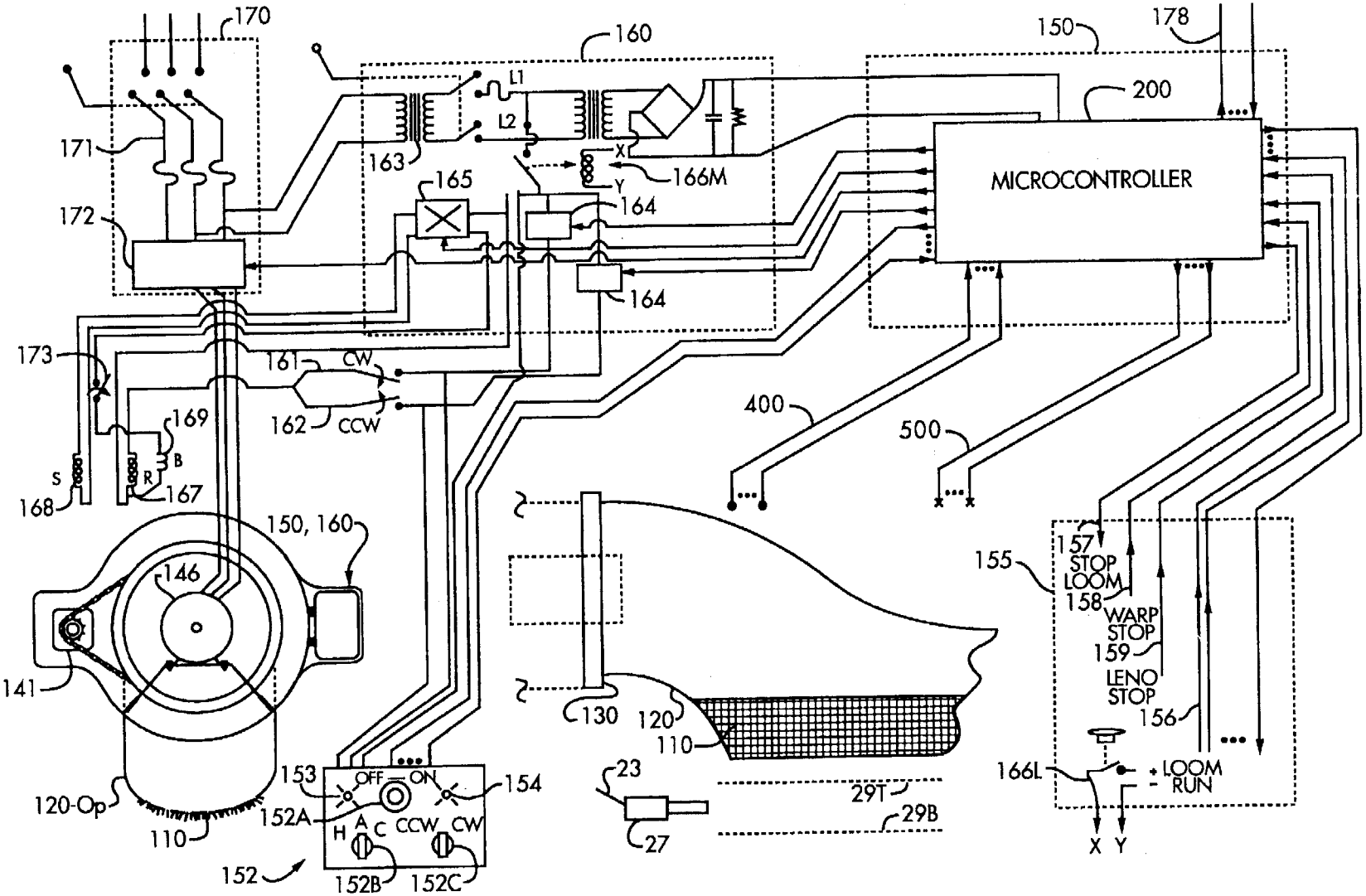
FIG. 7 depicts in highly schematic form a control system of the subject invention.

Two cases will illustrate an automatic RETRACT function. First, if any one of the warp ends 21 in FIGS. 3A or 5 breaks, the drop-wire stop motion 58 will stop loom 20. In FIGS. 6B and 7, MECA-W electronics 150 receive two signals from loom electronics 155, warp stop 158 (12 changing to 0 volts, seen across shorting bars within stop motion 58) and LOOM NOT RUN 156 (opening of dry contacts). When both conditions exist, microcontroller 200 or other electronics means causes gear motor 141 to drive collector 120 from OPERATE position 120-Op (FIGS. 4A, 5A) to the RETRACT position 120-R (FIGS. 4B, 5B), in about fifteen seconds, where it remains until the broken warp yarn end 21 is repaired by the weaver. When the repair is finished, the weaver restarts loom 20. Microcontroller or other electronics 200 recognizes that all warp yarn ends 21 are intact (12 volts at input 158) and that the loom is running 156 (closure of LOOM RUN dry Contacts). After a user-settable delay, typically of ten seconds, microcontroller 200 causes collector 120 to rotate clockwise until it again reaches OPERATE position 120-Op (FIG. 5A), where collector 120 remains until another stop occurs which requires retraction.

As the second illustrative example, one such other stop is a "Leno" stop motion 159. The Leno apparatus 19, shown only in FIGS. 4A and 4B, enables formation of a better selvage for the woven cloth and is located behind harness 52 but in front of warp stop motion apparatus 58. Left 19 and/or right (not shown) Leno apparatus are used, depending on the fabric being woven. Free access to correct Leno 19 stops also necessitates rotation of collector 120 to RETRACT position 120-R. The signals 159, 156, logic, and microcontroller 200 actions to this stop, its repair, and to loom restart are identical to the warp stop case just explained above.

Other loom stops do not necessarily require automatic movement to RETRACT and return (after delay) to OPERATE positions. Stops related to failure to insert filling yarn 23 correctly also stop the loom and provide annunciation for the weaver. But in these cases, repair is made in front of harness 52, in front shed 28, to filling yarn deliveries 26 or packages 24, to the right selvage, etc., and collector 120 can remain in OPERATE position 120-Op.

As seen in FIG. 7, the automatic control functions of microcontroller 200 can be overridden by moving mode selector switch 152B from AUTO (A) to HAND (H) position. The operator can then cause gear motor 141 to move the collector from OPERATE (fully CW in FIG. 5A) to CLEAN (C) (fully CCW in FIG. 5C) by means of momentary rotation direction switch 152C. HAND movement of collector 120 is used when major loom changes or repairs are required, or when it is desired to move to CLEAN position 120-C (FIG. 5C) under HAND control.

HAND (or AUTOMATIC) movements beyond fully CCW (CLEAN 120-C) or fully CW (OPERATE 120-Op) are precluded by customary limit switches 161, 162 in FIG. 7. However, if limit switches 161,162 fail, strong mechanical limits stop any further movement after the shearing of a torque-limiting pin in inner ring 130-I which engages chain 139 (FIG. 6B).

Unattended movement to CLEAN 120-C may be realized by placing MODE switch 152B to CLEAN and pulling mushroom switch 152A fully out, momentarily. Momentary contacts in switch 152A cause microcontroller 200 to rotate to CLEAN position 120-C, at which position CCW limit switch 162 stops rotation. This motion is also achievable with remote initiation via microcontroller 200 communication interface 178 to external computer or control electronics.

Collector 120 is rotated to CLEAN position 120-C (FIG. 5C) for removal of dust and fibers from capture surface 110. This removal is preferably by hand; about one pound of total dust is typically captured on capture surface 110 in 12 hours of processing denim. Following the cleaning step, which takes less than one minute (10–15 seconds, typically), mode switch 152B is moved to AUTO (A) and collector 120 rotates, after a delay of preferably ten seconds, toward OPERATE position 120-Op (FIG. 5A). Travel time from CLEAN 120-C (FIG. 5C) to OPERATE 120-Op (FIG. 5A) is about thirty seconds.

A brief overview of the main and control power elements 170,160 in FIG. 7 completes our disclosure of blower motor excitation and MECA collector 120 motion control. Three phase power, preferably 575 volts AC, 60 Hertz in the United States or 380 V, 50 Hz in Europe, for example, is delivered by disconnect and circuit protection 171 to variable frequency converter 172 and then to blower motor 146. One phase of this electrical power is carried from main power box 170 to control power box 160, where single phase control power, 115 VAC, 60 Hertz, is developed by control transformer 163. This power is then used to supply gear motor 141 via well-known and conventional solid state relays 164 and dry contact relay 165. Relay element 165 is a reversing relay which enables gear motor 141 to rotate CW or CCW. Gear motor 141 is preferably a split phase alternating current motor having running coil 167, starting coil 168, and brake coil 169. Thermal switch 173 disconnects starting coil 168 excitation, via reversing relay 165, after the motor 141 is up to speed. Other control power voltages, including DC and control components, are well known in the art and may be used. Pneumatic or hydraulic means could also be used.

Special notes are made in reference to frequency converter 172 and lock-out relay 166. Converter 172 is controlled by microcontroller 200, by other computer means, or manually. This enables controlling the pressure and/or flow performance of blowers 147, 148 (FIGS. 6A, 6C) according to optimal control strategies to be discussed later. Lock-out relay 166 assures safety. Relay 166M coil is excited only when the loom lock-out switch 166L is in ON. This means that when the loom 20 motion is locked out, so is motion of MECA collector 120.

C3. Continuous Blow-Off cleaning (MECA-2)

FIG. 6C shows again the high flow (approximately 2000 CFM), low static pressure (approximately 2 inches water column) blower wheel 147, described above and in FIG. 6A, in combination with a low flow (approximately 300 CFM), high static pressure (8 inches WC) blower wheel 148 mounted on a common shaft 202 extended from motor 146 and driven thereby. Blower wheel 148 preferably has forward curved blades 204 (FIG. 6D) and a larger diameter than blower 147, which preferably has backward inclined blades. The different flow and static pressure capabilities required lead to the different blower blade configurations and sizes.

Figure 6C:
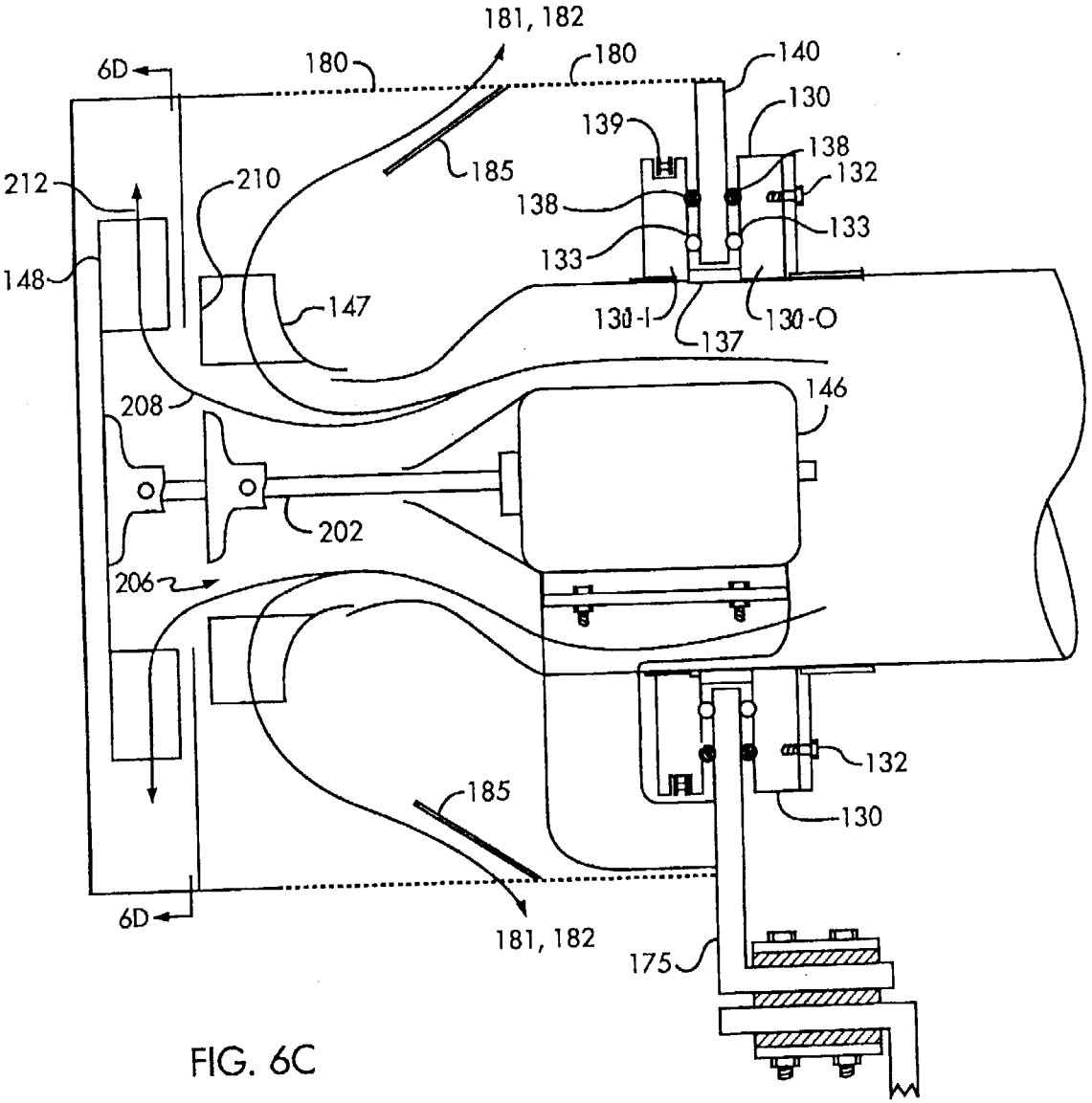
FIG. 6C is a view similar to FIG. 6A, of a modified embodiment.

Blower 147 delivers its high flow, low static pressure air flow components 181, 182 in FIG. 6C more fully around the periphery of general diffuser 180 since directed source-capture air 123 (FIG. 5A) and the elements which enable this air 123, namely, directed diffuser 194 and conduit 170, are omitted. These air flow components 181, 182 produce a more or less conical air flow pattern, which is caused by internal vanes 185. Those air flow components 181, 182 move back toward capture surface 110, as seen in FIGS. 4A and 5A, where they mix with room air components 121 and 122 upon entering collector 120.

Figure 6D:
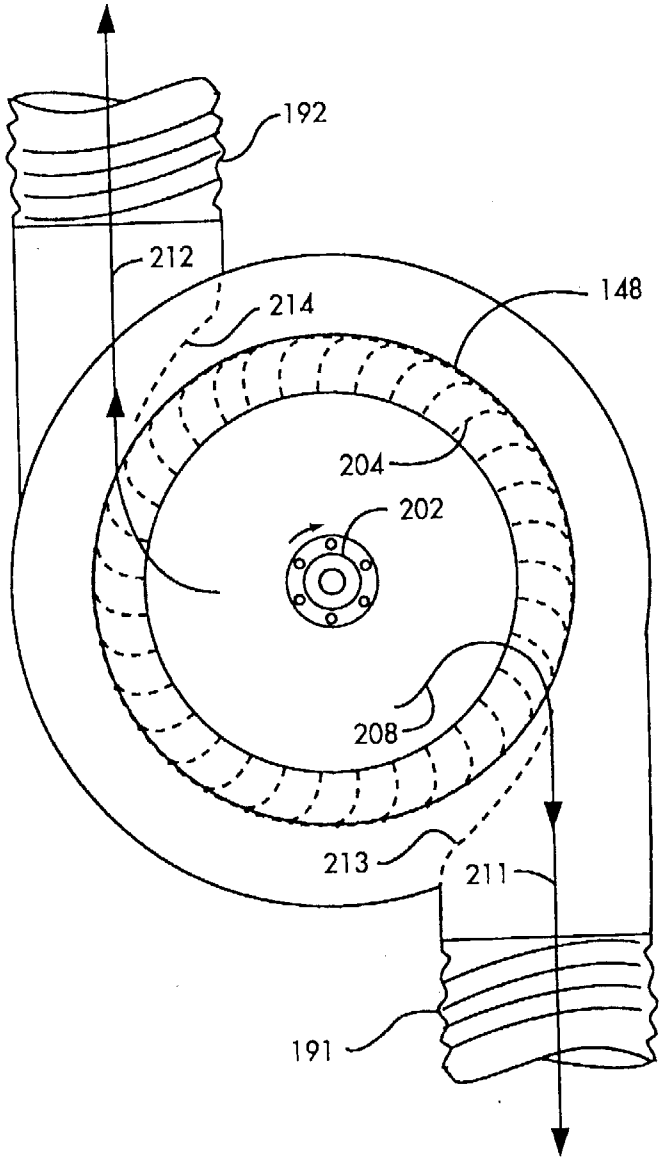
FIG. 6D is a view taken on line 6D—6D of FIG. 6C, showing the blower wheel.

Blower 148 derives its inlet flow 208 from holes 206 in the back plate 210 of blower wheel 174 and delivers its low flow, high pressure outlet flow 211, 212 into conduits 191, 192. Also shown in FIG. 6D are usual flow strippers 213, 214 for forward curved blowers which facilitate pressure recovery in conduits 191, 192. FIG. 6D shows dual deliveries into conduits 191, 192 but one or three or four or more may be used.

To summarize, this second embodiment, MECA-2, consists of air and collector drive unit 140 (FIG. 6C), having dual delivery (via conduits 191, 192) low flow, high pressure blower 148 (FIGS. 6C, 6D), in combination with directed distributors 230, 232 shown in FIG. 3B. MECA-2 supplies source air flow components 181, 182 from high flow, low pressure blower 147 in the more or less conical pattern described above. MECA-2 otherwise externally resembles the MECA-1 embodiment of FIGS. 1, 2, 3A, 4A and 5A except for the omitted diffuser 194.

Referring to FIG. 3B, which shows the important internal arrangements of elements, we now explain how continuous blow-off cleaning is realized. Conduits 191, 192 deliver low flow, high pressure air flow components 212, 214 (FIG. 6D) to blow-off distributors 230, 232 which are seen to apply high velocity blow-off jets 234, 236 to the drop wires in stop-motion assembly 58 or to the reed 56. Dust and fibers are thereby released and carried by capture air flow components 181, 182, 121, 122, along with other emissions 46–49, to capture surface 110.

Blow-off jets 234, 236 are elongated slots in conduits 230, 232 which are preferably 6 inches in diameter and extend fully under shed 28, 29 and cloth 25 for a length of, typically, 66 inches. Conduits 230, 232 can oscillate around their axes, thus sweeping or scanning blow-off jets 234, 236.

Blow-off jets 234, 236 continuously operate and furthermore operate continuously across the weaving machine in this MECA-2 embodiment.

In some weaving applications, it is necessary to have blow-off jets having higher velocities (i.e., driven by higher static pressure) than can be achieved with a single stage forward curved blower 148. In those cases, well-known multiple stage blowers can be used or a single blower operating at higher speed can be used. However, since blower power requirements increase as the product flow rate and total pressure, and since in some cases periodic blow-off is acceptable, FIGS. 3C and 3D show a scanning blow-off distributor 240.

Holes 242 are provided in a serpentine or barber-pole pattern around and along internal cylinder 244 which is supported and rotated by motor 246. Bearing 243 supports the left end of cylinder 244. Low flow, high pressure air 212 is delivered, via conduit 192, from blower 148 (FIGS. 6C and 6D) or from alternate means having higher pressure. Preferably, the outside diameter of blow-off distributor 240 is 4 inches, holes 242 are 0.75 inch diameter and drilled on 1.0 inch centers. Motor 246 rotates internal serpentine cylinder 244 at about 30 RPM, thus scanning the blow-off jet 250 across the length of the distributor 240 once in 2 seconds. The length is set by the cloth 25 being woven in loom 20 (FIG. 2) but is typical 66 inches.

C4: High Local Exchange Rates and Tightly-Coupled Process Zones (MECA-3)

Loom/Room

It was noted above that major distinguishing features of MPZEC methods and apparatus are the proximity of source and capture elements to the process zone; flexibility, generality, and speed of controlling a plurality of environmental parameters within a plurality of process zones within each machine; and ultimately, optionally controlling process performance parameters which respond to environmental parameters. Since volumetric exchange rate calculations are well known in the art of central environmental control, we now briefly develop this concept to the end of more fully explaining some of the novel features of our invention which dramatically distinguish it from prior art.

Consider first a loom 20 situated in a processing room environment 112. Associate with the loom 20 a floor area of 16 feet by 16 feet=256 $FT^2$ and a ceiling height of 18 feet. This is clearly a per loom expression of this totality of looms 20 situated in the entire processing environment 112. If a central air conditioning system supplies and returns 2000 CFM to the volume associated with this one loom 20, 256 $FT^2 \times 18\ FT^3 = 4{,}608\ FT^3$, the volumetric exchange rate E is $$E = 60\frac{Q}{V} = 60 \times \frac{2000}{16 \times 16 \times 18} = 26 \text{ changes/hr.}$$

This rate is representative of current practice, as noted above.

MECA-1

Next consider the MECA-1 embodiment in FIGS. 1, 2 and 3A. By design, much of the air flow captured by collector 12D is sourced, in close proximity, from general diffuser 180 and directed diffuser 194. Assume 50% recirculation and total flow=2000 CFM. This means that 50% of the captured air flow components 121, 122, 123, 181, 182 originates with the room environment 112 air flow components 121, 123. Alternatively, air flows 121, 122 are numerically equal to air flows 123, 181, 182. Assume further that close proximity means that the 50% recirculated is confined to an effective volume defined by the loom width and depth, both about 8 feet. Assuming an effective height of 6 feet gives $$E = 60 \times \frac{2000 \times 0.5}{8 \times 8 \times 6} = 156 \text{ changes/hr.}$$

The interpretation of this result is simple and significant: proximity enhances exchange rate. This means that emissions are far more effectively captured. Also, the effective volume is much more quickly changed or, alternatively stated, the response time is much shorter.

There are "down-sides": proximity can mean interference with weaving operations; quick response requires fast sensors and controls; and recirculation can lead to different equilibrium levels for environmental parameters (dust and heat build-up, moisture loss, etc). Those "down-side" problems are readily solved in the methods and apparatus described herein.

MECA-3

Figure 8A:
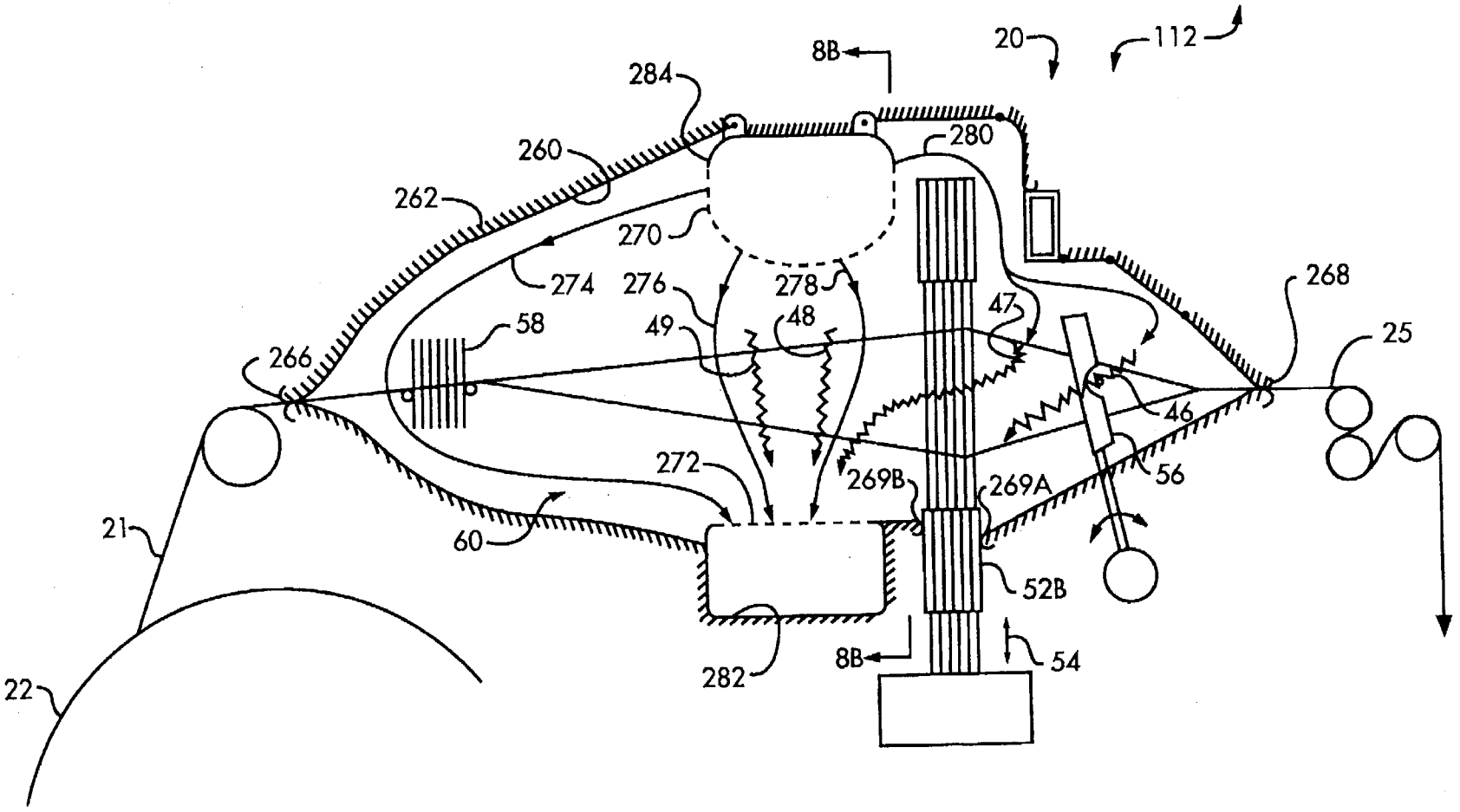
FIGS. 8A and 8B depict downward flow from a directed source diffuser.

Noting the up-side or positive results associated with higher exchange rate, and recognizing the down-side solutions, it is most informative to compute a limiting exchange rate for MECA-3 described in FIG. 8A. The volume 260 within the insulated (thermally and acoustically) process zone envelope 260 is roughly 6 FT (cloth 25 width) by 4 FT (front to back depth)×2 FT (effective height)=48 $FT^3$ and, for Q=2000 CFM, $$E = 60 \times \frac{2000}{48} = 2500 \text{ changes/hr.}$$

Evidently, proximity indeed enhances exchange rate.

It is also informative to calculate the minimum clearing or change time for this tightly-coupled embodiment:

$$T = \frac{V}{Q} = \frac{48}{2000} = 0.024 \text{ min} = 1.4 \text{ sec.}$$

This result represents a characteristic time for the flow Q to exchange or "clear out" volume V of process zone volume 260. This is the minimum time in which changes to environmental parameters (dust concentration, temperature, humidity, etc.) in process zone 260 can be made.

Process zone enclosure 260 in FIG. 8A represents a limiting concept wherein the process zone 60 is isolated by thermal and acoustic insulation 262. The materials to be processed, warp 21 and filling 23 yarns, are introduced into the process zone through seals 266, for the warp yarn 21, and similar but unshown seals for the filling yarn 23. Cloth 25 is delivered from envelope 260 via seal 268. Seals 269A, 269B operate against bottom harness frame 52B. Additional seals are, of course, required and their designs are well known. In some cases it is also necessary to enclose filling yarn packages 24 and accumulators 26 (FIG. 2).

Whereas the process zone 260 volumetric calculated above was seen to be very high, E=2500 changes/hour, which is about 100 times higher than prior art central air conditioning systems, and the cleaning time T=1.4 seconds is very short, these parameters only partially explain the benefits of our invention. Major advantages of "tightly-coupled", modular process zone environmental control over prior art include:

1. Possibilities to process materials in process zone environments totally different from or incompatible with employee zone environments. To dramatize: when economically justified, weaving can be performed at extremes of temperature or gas composition, at 300° F. or in a noble gas for examples. In some cases, different process zone environments facilitate the justifications. Weaving at 150° F. in an insulated process zone can lead to dramatic savings in air conditioning costs.
2. Control of the processing machines on a machine-by-machine basis.
3. Rapid control response.
4. Almost complete capture of emissions.

It is now clearer that "tightly-coupled" means more than a closely proximate, small, tightly-sealed process zone 60 within envelope 260; it means that the process zone 60 environmental parameters are almost completely controlled by, or are "tightly-coupled" to, the modular environmental control apparatus. Tightly-coupled also means, machine-by-machine, gross profit optimization.

Figure 8B:
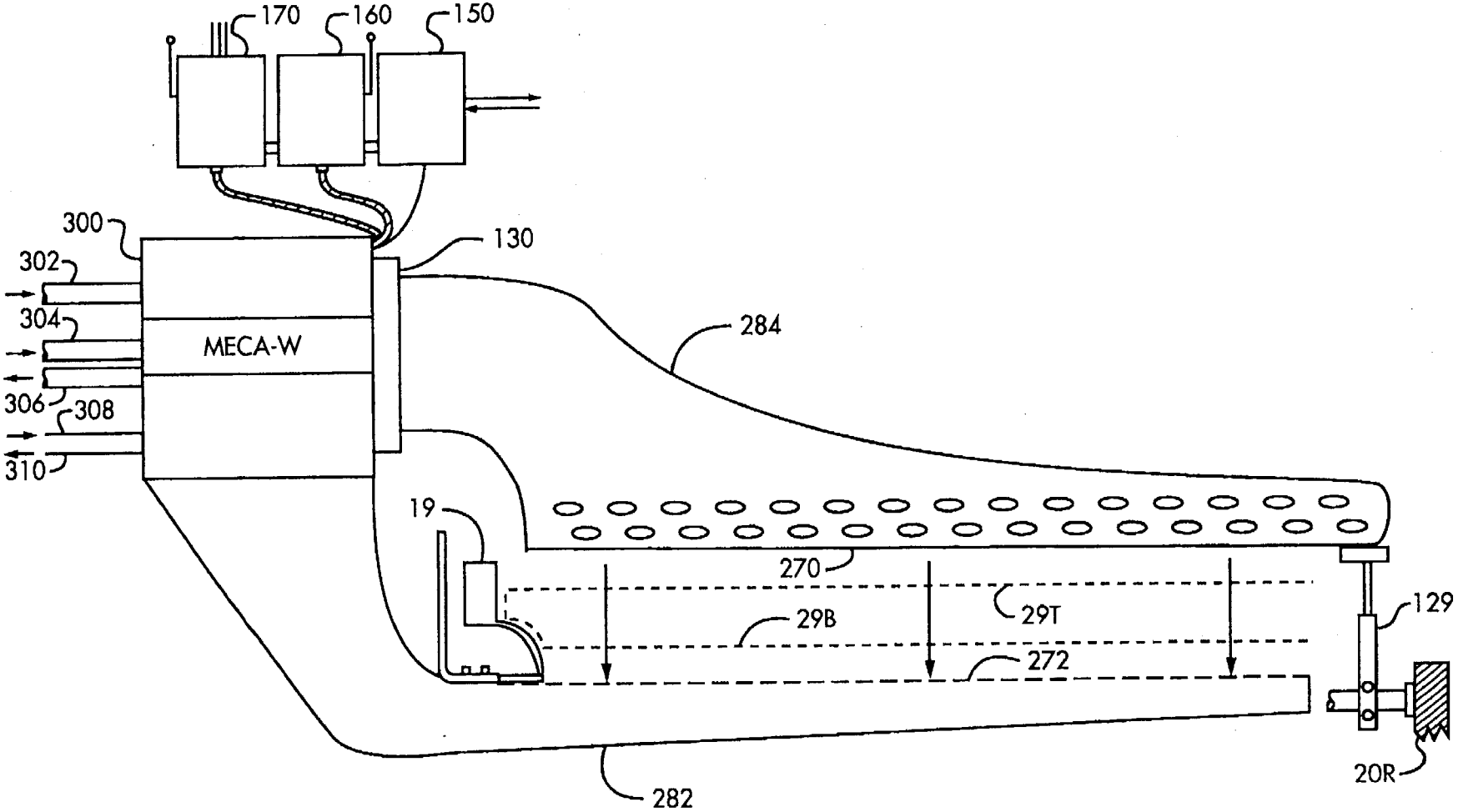

FIGS. 8A and 8B show for MECA-3 downward flow from directed source diffuser 270 to capture surface 272 in contrast to upward flow for MECA-1. Downward flow components 274, 276, 278, 280 carry emissions 46–49 into capture surface 272. Dust is not collected on capture surface 272 but is transported by collector-conduit 282 to filtration means in air drive unit 300 such as is taught in FIG. 12 of Shofner U.S. Pat. No. 4,881,957

Collector-conduit 282 is stationary because it is less practical to move it out for cleaning than to perform the filtration externally in air drive unit 300. Source diffuser 270 and its air supply conduit 284 must be retractable and, of course, process zone envelope 260 must also automatically retract. Conduit 284 is rotatably retracted by rotary joint 130, exactly as collector 120 was retracted as described in FIGS. 5A and 5B. The retraction of the top of envelope 260 follows the design of MECA-4, described below.

FIG. 8B shows a pure water conduit 302 feeding into drive unit 300 for humidification of the process zone environment. A humidity sensor within said environment impresses a signal onto one of microcontroller 200 inputs 400 (FIG. 7) and the amount of moisture delivered to the environment is controlled by one of microcontroller 200 outputs 500. Conduits 304, 306 deliver cooling fluid to drive unit 300. Heat is exchanged via well-known coils and the cooling fluid parameters are sensed and controlled by microcontroller 200 inputs 400 and outputs 500. Electrical conductors 308, 310 similarly enable control of ion content, under microcontroller 200 control. All of these, and other environmental parameters within process zone 60 are supplied, sensed, and controlled by well-known means.

Similar environmental controls 302, 304, 306, 309, 310 are shown servicing drive unit 140 in FIG. 4A.

MECA-4

Figure 9A:
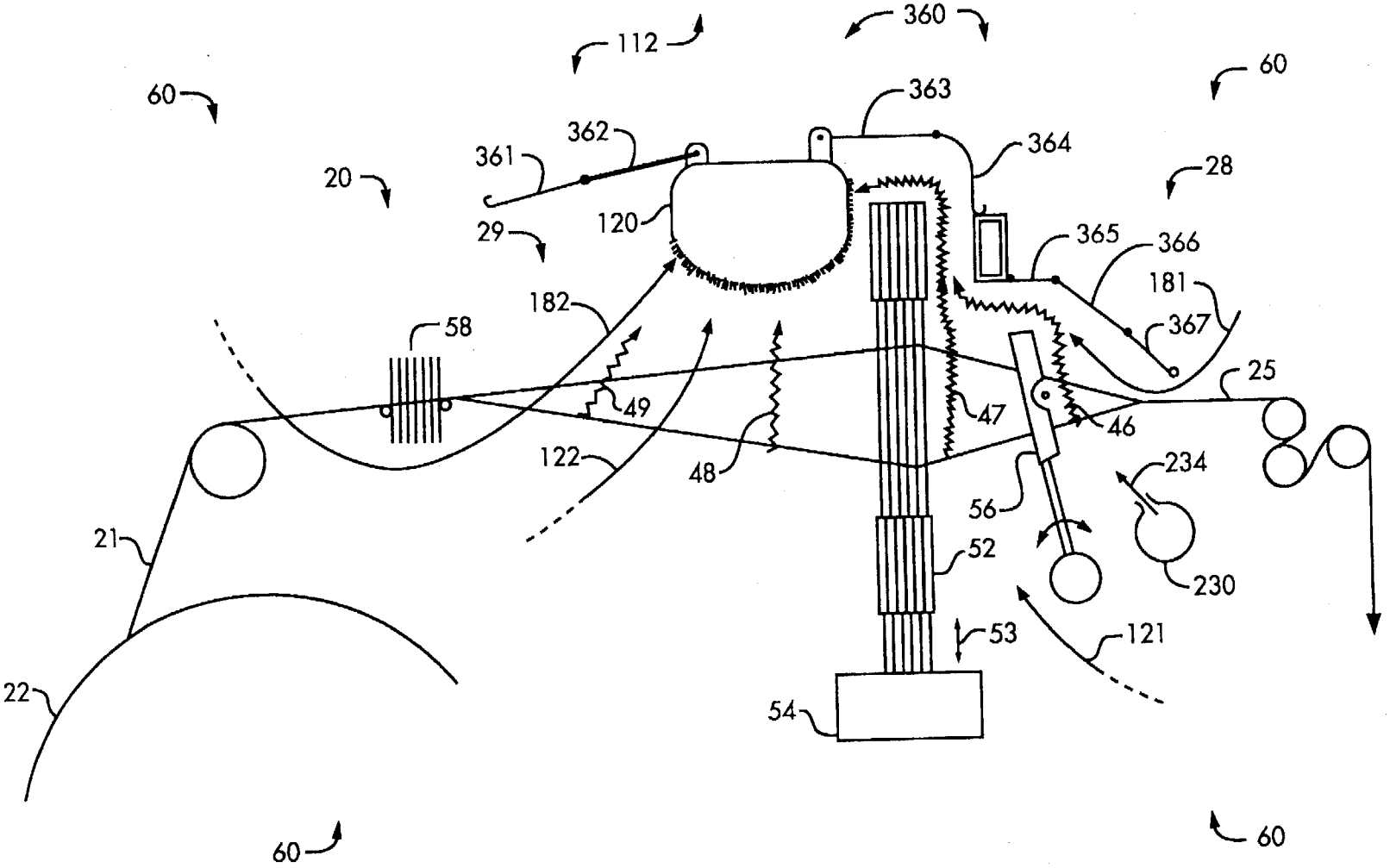
FIGS. 9A and 9B depict several conditions of a foldable envelope.

Whereas MECA-3 represents a limiting concept for proximity or tight coupling, the embodiment of FIG. 9A represents a practical compromise which is particularly effective for retrofit installations. Much of the detail in FIG. 9A is seen hereinabove in FIGS. 3A and 3B in the MECA-1 and MECA-2 embodiments and the elements included in FIG. 9A have the same meanings and functions. The directed diffuser 194, seen under shed 29 in FIG. 3A, is excluded, and one continuous blow off air 234 distributor 230, as first seen in FIG. 3B, is added. Humidification water via conduit 302 (FIG. 4A), cooling fluid via conduit 304, 306, and electrical power via conductors 308, 310 would be used as necessary and justified.

To complete the major elements for MECA-4, partial envelope 360 is added and comprises three sets of hinged covers 361,362; 363,364; and 365,366,367. When envelope 360 is closed, as in FIG. 9A, preferred patterns in capture air flows 121, 122, 181, 182 and including continuous blow-off jet 234 are established. Covers 361,362 cause air from the MECA-4 general diffuser, components 181, 182 and from the room environment 112, namely 121, 122, to mix and flow down into and then up through the warp yarn 21 in back shed 29. This results in significantly improved environmental parameters in back shed 29 (reduced temperature, elevated humidity, and lower dust and fly concentration and deposition).

Covers 363,364 and 365,366,369 confine and constrain the vigorous fanning action of reed 56 and provide a flow path for emissions 46,47 to reach collector 120. Release and transport of emissions 46,47 are aided by continuous blow-off air jet 234.

Note that cover plate 367 does not contact or seal against cloth 25, but rather allows air flow component 181 to enter. Note also that continuous blow-off air jet 234 may be highly humidified to enhance warp 21 yarn strength and elasticity, i.e., to "toughen" the yarn in front shed 28.

Figure 9B:
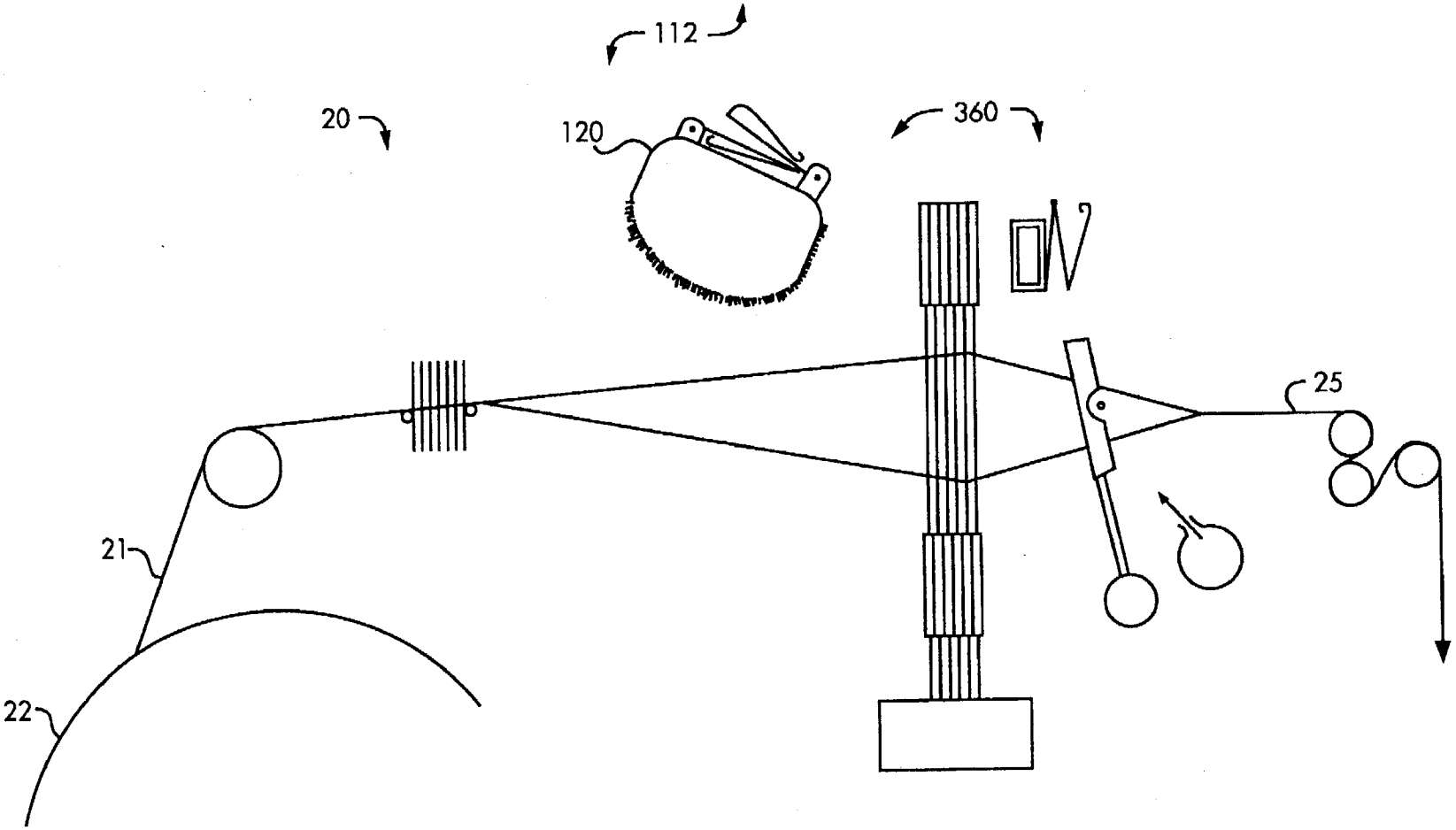

FIG. 9B shows partial envelope 360 folded into RETRACT mode and collector 120 moved partially toward RETRACT position. (The individual segments 361–367 are shown slightly open or separated for clarity.) The elements in FIG. 9B are the same as in FIG. 9A. Only essential reference numbered elements are retained in order to show how completely partial envelope 360 is retracted.

C5: Exemplary Results

Two secret trials have yielded the following performance results with air jet looms operating at 600 picks/min.

1. Denim, MECA-4
   - Respirable Dust
     - Employee Zone 1300→350 μg/m$^3$
     - Process Zone 3000→500 μg/m$^3$
   - Total Dust Captured 1 pound/12 hours
   - Process Zone Thermal—1.7° F., +5.5% RH
   - Weaving Performance Not Yet Evaluated
2. Twill, MECA,1
   - Dust Performance Not Evaluated
   - Weaving Performance:
   - Filling Stops Reduced from 4 to 2 per 100,000 picks.

Optimal Process control

The invention also enables implementation of one or more optimal process control strategies. Whereas the first major objective is provision of conditioned gas flows to and from one or more process zones in each machine, said conditioned gas flows enabling the control of one or more environmental parameters therein, this second objective extends most significantly the utility of the invention by enabling optimal control of one or more performance parameters of each materials processing machine. This optimal control of processing performance parameters is achieved in two ways: first, by controlling those processing performance parameters which respond, at least in part, to process zone environmental parameters and, second, by controlling machinery settings to realize the overall optimal process performance. To emphasize and clarify, we are not attempting to hold any process zone environmental parameter constant; rather, we intend to optimize one or more processing parameters which respond to the process zone environmental parameters. In usual practice, overall optimal process performance means maximizing gross profit, but it can mean maximizing quality, efficiency, throughput or production rate, employee morale, etc. Of course, it is highly unlikely and unnecessary that any two or more of these overall process parameters will or can maximize simultaneously for any one materials processing machine.

Shofner et al U.S. Pat. No. 5,560,194, titled "Method for Optimally Controlling Fiber Processing Machines," issued from application Ser. No. 341,292, filed Nov. 15, 1994 as a continuation of Ser. No. 999,212, filed Dec. 31, 1992, and now abandoned, the disclosure of which was published as European Patent Application Publication No. 0,604,876 titled "Methods for Optimally Controlling Fiber Processing Machines"; and Shofner et al U.S. Pat. No. 5,361,450 titled "Direct Control of Fiber Testing or Processing Performance Parameters by Application of Controlled, Conditioned Gas Flows" the entire disclosures of which are hereby incorporated by reference, represent "state of the art" concepts at the time of their initial U.S. filings.

U.S. Pat. No. 5,560,194 is directed toward fiber processing, ending with spinning fibers into yarn, and is totally silent on optimal controls via control of environmental parameters in the machinery process zones. (The preferred embodiment for U.S. Pat. No. 5,560,194 is open end spinning, FIG. 1 therein.)

U.S. Pat. No. 5,361,450 is also directed toward control of fiber processing performance parameters (preferred embodiment carding, FIG. 6 therein), via control of environmental parameters in the machinery process zones, but the process zone environmental parameters are themselves controlled by application of controlled, conditional gas flows delivered from improved central air conditioning systems (FIG. 10 in U.S. Pat. No. 5,361,450). U.S. Pat. No. 5,361,450 is totally silent on fabric formation (weaving or knitting), on generic materials processing, or on modular process zone environmental control.

In view of the foregoing, it will be appreciated that extensive research and development by the present inventors has revealed limitations of the prior art, and has led to the inventions with respect to modular process zone environmental control disclosed hereinabove.

While prior art central air conditioning systems can control to or "hold" reasonably uniform (spatially) and stable (temporally) desired humidity and temperature conditions, as monitored by one or more chart recorder/controllers 13 in the process room, they cannot, without the improvements of U.S. Pat. No. 5,361,450, "hold" such air conditions in each and every weaving process zone and cannot always achieve compliance with the OSHA respirable dust standard. Nor can prior art central air conditioning systems significantly effect collection of dust and fiber or reduce noise emissions.

Prior art central air conditioning typically cannot control the process zone environmental conditions on a machine-by-machine basis. The subject invention, for all weaving manufacturing processes, operates to generate or hold more favorable environmental conditions in the weaving process zone, to capture dust and fibers, including respirable dust, before they spread into the workplace, and to suppress noise emissions.

The invention provides further fundamental advantages over travelling cleaners and prior art central air conditioning, further improves the improvements disclosed in U.S. Pat. No. 5,361,450. Whereas it is a purpose of the invention to replace travelling cleaners with MECA-W units in most cases, it is not intended to eliminate central air conditioning, in general, but rather to reduce the demands on it to primarily provide conditioned air for the employee zones. Central air conditioning can effectively meet these demands of air conditioning employee work zones but cannot effectively handle process zone environmental control. The methods and apparatus of the instant invention can advantageously handle process zone environmental control.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A method for optimally processing materials in a material processing machine having at least one material input, at least one processing zone and at least one material output, said method comprising the steps of:

determining a machinery model which simulates the operation of the materials processing machine given a range of input material parameters at least at a first time by:

a. measuring materials processing characteristics of the machine over ranges of environmental parameters within the at least one processing zone, said characteristics defining the interrelationships between input material parameters and output material parameters over said ranges of environmental parameters;

b. defining said machinery model from said characteristics;

measuring at least some of the input material parameters at the at least one material input of said materials processing machine at least at a second, later time;

introducing the at least some of the measured input material parameters into said model and then determining environmental parameters within the at least one processing zone, within a predetermined range of acceptable variation, which environmental parameters optimize at least one output material parameter; and processing material while applying controlled conditioned gas flows to the at least one processing zone to achieve the environmental parameters which optimize at least one output material parameter.

2. The method of claim 1, wherein:

the step of determining a machinery model at least a first time further comprises measuring material processing characteristics of the machine over ranges of machinery settings, said characteristics defining the interrelationships between input material parameters and output material parameters over said ranges of machinery settings;

after the at least some of the measured input material parameters are introduced into said model, machinery settings within a predetermined range of acceptable variation are also determined, which settings optimize at least one output material parameter; and the step of processing material comprises processing material with said optimally adjusted machinery.

3. A method for processing material in a machine having at least one processing zone, said method comprising:

providing at least one modular environmental control unit measuring at least one processing performance parameter; and at least partially controlling the at least one processing performance parameter in accordance with a predetermined optimal control strategy by deliberately applying a gas flow conditioned by at least one controlling parameter, said gas flow being applied to the at least one processing zone of the machine by at least one modular environmental control unit;

the modular environmental control unit including at least one of a gas flow source element and a gas flow capture element, a mechanism for selectively positioning said at least one of a gas flow source element and a gas flow capture element in a mechanically predetermined operate position proximate the at least one processing zone, or in a mechanically predetermined retracted position, elements to control conditions of the gas flow, and at least one blower for causing gas flow through the at least one processing zone of the machine.

4. The method of claim 3, wherein the at least one processing performance parameter is selected from the group consisting of material throughput, machine production efficiency, machinery production costs, input material value, output material value, and profit.

5. The method of claim 4, wherein the controlled conditions of the gas flow are selected from the group consisting of temperature, humidity, dust concentration, gas composition, volumetric flow rate, static pressure, free charge concentration, static charge, radioactive particle concentration, velocity, velocity fluctuations, and pressure fluctuations.

6. The method of claim 3, wherein the controlled conditions of the gas flow are selected from the group consisting of temperature, humidity, dust concentration, gas composition, volumetric flow rate, static pressure, free charge concentration, static charge, radioactive particle concentration, velocity, velocity fluctuations, and pressure fluctuations.

7. The method of claim 3, which comprises controlling a plurality of processing performance parameters in accordance with said predetermined optimal control strategy.

8. The method of claim 3, wherein the mechanism included in the provided modular environmental control unit positions the at least one of a gas flow capture element and a gas flow source element within thirty inches of the at least one processing zone in the mechanically predetermined operate position.

9. The method of claim 3, which comprises positioning the at least one of a gas flow capture element and a gas flow source element within three inches of the at least one processing zone in the mechanically predetermined operate position.

10. The method of claim 3, which comprises processing material in a textile processing machine.

11. The method of claim 3, wherein the at least one processing performance parameter is selected from the group consisting of trash content, nep content, short material content, trash removal efficiency, nep removal efficiency, short material removal efficiency, machine production efficiency, and material value.

12. The method of claim 3, wherein the machine is a textile yarn processing machine.

13. The method of claim 12, wherein the textile yarn processing machine is a weaving machine.

14. The method of claim 12, wherein the at least one processing performance parameter is selected from the group consisting of cloth throughput, cloth cleanliness, machine production efficiency, stop frequency, stop rate, machinery production cost, input yarn value, output cloth value and profit.

15. A method for optimally processing input materials into output materials wherein the method is carried out in a materials processing machine having at least one processing zone, with said machine operating near target operating point parameters, said method comprising the steps of:

providing a range of input material having parameters corresponding to a usable range of such input material, including a substantially complete set of samples of various usable qualities of the input material available;

operating the machinery over the entire range of provided input materials to generate output materials having a range of output material parameters;

varying environmental parameters within the at least one processing zone over a range of environmental parameters while operating the machine over the range of input material to generate the output material such that substantially all combinations of input materials and environmental parameters are used to generate output materials;

testing the input and output materials to determine various output material parameters at substantially all combinations of input material parameters and environmental parameters;

generating a database of substantially all combinations of input material parameters, process zone environmental parameters, and output material parameters;

selecting a target operating point including at least one parameter selected from the group consisting of input material parameters, process zone environmental parameters, and output material parameters;

defining a model of machinery performance based upon a selected portion of the database which is within a predetermined region of the target operating point;

using the model for determining at least one optimal parameter from the group consisting of the optimal input material parameters, the optimal process zone environmental parameters, and the optimal output material parameters; and operating the machinery to process input material and to produce output material in accordance with the selected optimal parameter being within acceptable variability of the target operating point.

16. The method of claim 15, wherein:

the step of varying environmental parameters while operating the machine further comprises varying the control settings of the machine over their full range such that substantially all combinations of input materials, machine control settings and environmental parameters are used to generate output material; wherein the step of testing further comprises testing the input and output materials to determine various output material parameters at substantially all combinations of input material parameters, machine control settings, and environmental parameters; wherein the step of generating a database further comprises generating a database of substantially all combinations of input material parameters, machine control settings, process zone environmental parameters and output material parameters; wherein the step of selecting a target operating point further comprises selecting a target operating point including at least one parameter selected from the group comprising the input material parameters, machine control settings, process zone environmental parameters, and output material parameters; and wherein the step of using the model further comprises using the model for determining at least one optimal parameter from the group consisting of the optimal input material parameters, the optimal machine control settings, the optimal process zone environmental parameters, and the optimal output material parameters.

17. A method for selecting input materials having optimal input material parameters for input into materials processing machinery to achieve an output of material parameters corresponding to a target operating point, comprising the steps of:

determining a machinery model which simulates the operation of a materials processing machine given a range of input materials parameters by:

a. measuring materials processing machinery characteristics over ranges of operational settings and environmental parameters within processing zones, said characteristics defining the interrelationships between input materials parameters and output materials parameters over said ranges of machinery settings and environmental parameters; and b. defining said machinery model from said machinery characteristics;

determining characteristics of a desired output materials parameter or profit;

introducing said output material parameters into said machinery model which determines the optimum range of input material parameters;

selecting input materials having parameters coinciding, within an acceptable range of variability, with the determined optimum range of input materials parameters;

providing said selected input materials as input to a materials processing machine; and operating the machinery with the selected input materials to produce the output corresponding to the target operating point.

18. A method for optimally processing materials in a plurality of sequentially related materials processing machines, each of which has a material input, a material output and a processing zone, said method comprising the steps of:

determining a composite machinery model which simulates the operation of the plurality of materials processing machines by:

measuring materials processing machinery characteristics over ranges of operational settings and ranges of environmental parameters within the processing zones for each of the machines, said characteristics defining the interrelationships between input material parameters and output material parameters over said ranges of machinery operational settings and environmental parameters within the processing zones, and defining the composite machinery model from said measured characteristics;

measuring input material parameters at the inputs to said material processing machines at least at a second, later time;

introducing said input material parameters into the composite model and then determining settings and environmental parameters for each machine, within a predetermined range of acceptable variation;

adjusting said settings and environmental parameters to optimize at least one output parameter; and processing materials with said optimally adjusted machines.

* * * * *